US008047377B2

(12) United States Patent
Makino

(10) Patent No.: US 8,047,377 B2
(45) Date of Patent: Nov. 1, 2011

(54) PACKAGING MATERIAL AND METHOD OF TRANSPORTING HONEYCOMB STRUCTURED BODY

(75) Inventor: Kenichi Makino, Ibi-gun (JP)

(73) Assignee: Ibiden Co., Ltd., Ogaki-shi (JP)

( * ) Notice: Subject to any disclaimer, the term of this patent is extended or adjusted under 35 U.S.C. 154(b) by 506 days.

(21) Appl. No.: 11/762,928

(22) Filed: Jun. 14, 2007

(65) Prior Publication Data

US 2008/0160249 A1 Jul. 3, 2008

(30) Foreign Application Priority Data

Jun. 6, 2005 (JP) ..... 2005-165758

(51) Int. Cl.
*B32B 3/12* (2006.01)

(52) U.S. Cl. ..... 206/589; 206/561

(58) Field of Classification Search ..... 206/557, 206/561, 562, 563, 564, 565, 505, 506, 507, 206/509, 588, 589, 593, 594; 428/116; 229/407; 53/456

See application file for complete search history.

(56) References Cited

U.S. PATENT DOCUMENTS

| | | | | |
|---|---|---|---|---|
| 5,830,548 | A * | 11/1998 | Andersen et al. | 428/36.4 |
| 5,914,187 | A | 6/1999 | Naruse et al. | |
| 6,093,460 | A * | 7/2000 | Iwaya | 428/34.2 |
| 6,669,751 | B1 | 12/2003 | Ohno et al. | |
| 7,112,233 | B2 | 9/2006 | Ohno et al. | |
| 7,309,370 | B2 | 12/2007 | Kudo et al. | |
| 7,332,014 | B2 | 2/2008 | Ono et al. | |
| 7,341,614 | B2 | 3/2008 | Hayashi et al. | |
| 7,348,049 | B2 | 3/2008 | Yoshida | |
| 7,387,829 | B2 | 6/2008 | Ohno et al. | |
| 7,393,376 | B2 | 7/2008 | Taoka et al. | |
| 7,396,586 | B2 | 7/2008 | Ohno et al. | |
| 7,427,308 | B2 | 9/2008 | Taoka et al. | |
| 7,427,309 | B2 | 9/2008 | Ohno et al. | |
| 7,438,967 | B2 | 10/2008 | Fujita | |
| 7,449,427 | B2 | 11/2008 | Ohno et al. | |
| 7,462,216 | B2 | 12/2008 | Kunieda et al. | |
| 7,473,465 | B2 | 1/2009 | Ohno et al. | |
| 2002/0033352 | A1 * | 3/2002 | Levin et al. | 206/589 |
| 2004/0161596 | A1 | 8/2004 | Taoka et al. | |
| 2005/0109023 | A1 | 5/2005 | Kudo et al. | |
| 2005/0153099 | A1 | 7/2005 | Yamada | |

(Continued)

FOREIGN PATENT DOCUMENTS

DE 2547822 4/1977

(Continued)

OTHER PUBLICATIONS

International Search Report issued to PCT/JP2006/303884 on Apr. 25, 2006.

(Continued)

*Primary Examiner* — J. Gregory Pickett
*Assistant Examiner* — King M Chu
(74) *Attorney, Agent, or Firm* — Ditthavong Mori & Steiner, P.C.

(57) ABSTRACT

A packaging material of the present invention, which comprises a plate member, packages an object to be packaged by sandwiching the object, and the plate member is provided with an installation portion for the object to be packaged as well as a reinforcing portion.

17 Claims, 14 Drawing Sheets

U.S. PATENT DOCUMENTS

| | | | |
|---|---|---|---|
| 2005/0169819 | A1 | 8/2005 | Shibata |
| 2005/0175514 | A1 | 8/2005 | Ohno |
| 2005/0180898 | A1 | 8/2005 | Yamada |
| 2005/0247038 | A1 | 11/2005 | Takahashi |
| 2005/0272602 | A1 | 12/2005 | Ninomiya |
| 2006/0029897 | A1 | 2/2006 | Saijo et al. |
| 2006/0029898 | A1 | 2/2006 | Saijo et al. |
| 2006/0043652 | A1 | 3/2006 | Saijo et al. |
| 2006/0051556 | A1 | 3/2006 | Ohno et al. |
| 2006/0073970 | A1 | 4/2006 | Yamada |
| 2006/0108347 | A1 | 5/2006 | Koyama et al. |
| 2006/0118546 | A1 | 6/2006 | Saijp et al. |
| 2006/0166820 | A1 | 7/2006 | Ogyu et al. |
| 2006/0210765 | A1 | 9/2006 | Ohno et al. |
| 2006/0216466 | A1 | 9/2006 | Yoshida |
| 2006/0216467 | A1 | 9/2006 | Yoshida |
| 2006/0222812 | A1 | 10/2006 | Koyama et al. |
| 2006/0225390 | A1 | 10/2006 | Yoshida |
| 2006/0230732 | A1 | 10/2006 | Kunieda |
| 2006/0245465 | A1 | 11/2006 | Saijo et al. |
| 2006/0269722 | A1 | 11/2006 | Yamada |
| 2007/0020155 | A1 | 1/2007 | Ohno et al. |
| 2007/0028575 | A1 | 2/2007 | Ohno et al. |
| 2007/0044444 | A1 | 3/2007 | Oshimi |
| 2007/0068128 | A1 | 3/2007 | Oshimi et al. |
| 2007/0085233 | A1 | 4/2007 | Yamada |
| 2007/0116908 | A1 | 5/2007 | Ohno et al. |
| 2007/0126160 | A1 | 6/2007 | Takahashi |
| 2007/0128405 | A1 | 6/2007 | Sakaguchi et al. |
| 2007/0130897 | A1 | 6/2007 | Sakaguchi et al. |
| 2007/0144561 | A1 | 6/2007 | Saijo et al. |
| 2007/0148403 | A1 | 6/2007 | Yamamura et al. |
| 2007/0152382 | A1 | 7/2007 | Yamada et al. |
| 2007/0169453 | A1 | 7/2007 | Hayakawa |
| 2007/0175060 | A1 | 8/2007 | Idei et al. |
| 2007/0178275 | A1 | 8/2007 | Takahashi |
| 2007/0187651 | A1 | 8/2007 | Naruse et al. |
| 2007/0190350 | A1 | 8/2007 | Ohno et al. |
| 2007/0196620 | A1 | 8/2007 | Ohno et al. |
| 2007/0199205 | A1 | 8/2007 | Hoshino et al. |
| 2007/0199643 | A1 | 8/2007 | Kawai et al. |
| 2007/0202455 | A1 | 8/2007 | Saijo et al. |
| 2007/0204580 | A1 | 9/2007 | Kunieda |
| 2007/0212517 | A1 | 9/2007 | Ohno et al. |
| 2007/0262498 | A1 | 11/2007 | Saijo et al. |
| 2007/0293392 | A1 | 12/2007 | Ohno et al. |
| 2008/0067725 | A1 | 3/2008 | Naruse et al. |
| 2008/0084010 | A1 | 4/2008 | Naruse et al. |
| 2008/0088072 | A1 | 4/2008 | Kobayashi |
| 2008/0106008 | A1 | 5/2008 | Kasai et al. |
| 2008/0106009 | A1 | 5/2008 | Naruse et al. |
| 2008/0116200 | A1 | 5/2008 | Kawai et al. |
| 2008/0120950 | A1 | 5/2008 | Ohno et al. |
| 2008/0136053 | A1 | 6/2008 | Kuribayashi et al. |
| 2008/0136062 | A1 | 6/2008 | Kasai et al. |
| 2008/0138567 | A1 | 6/2008 | Ninomiya et al. |
| 2008/0150200 | A1 | 6/2008 | Tajima |
| 2008/0157445 | A1 | 7/2008 | Kawai et al. |
| 2008/0174039 | A1 | 7/2008 | Saijo et al. |
| 2008/0190081 | A1 | 8/2008 | Oshimi |
| 2008/0190083 | A1 | 8/2008 | Oshimi |
| 2008/0197544 | A1 | 8/2008 | Saijo et al. |
| 2008/0213485 | A1 | 9/2008 | Shibata |
| 2008/0236115 | A1 | 10/2008 | Sakashita |
| 2008/0236122 | A1 | 10/2008 | Ito |
| 2008/0236724 | A1 | 10/2008 | Higuchi |
| 2008/0237942 | A1 | 10/2008 | Takamatsu |
| 2008/0241015 | A1 | 10/2008 | Kudo et al. |
| 2008/0241444 | A1 | 10/2008 | Oshimi |
| 2008/0241466 | A1 | 10/2008 | Saito et al. |
| 2008/0284067 | A1 | 11/2008 | Naruse et al. |
| 2008/0305259 | A1 | 12/2008 | Saijo |
| 2008/0318001 | A1 | 12/2008 | Sakakibara |
| 2009/0004431 | A1 | 1/2009 | Ninomiya |
| 2009/0107879 | A1 | 4/2009 | Otsuka et al. |
| 2009/0130378 | A1 | 5/2009 | Imaeda et al. |

FOREIGN PATENT DOCUMENTS

| | | |
|---|---|---|
| DE | 8809724 | 9/1988 |
| GB | 102744 | 1/1917 |
| GB | 1500233 | 2/1978 |
| JP | 37-9298 | 5/1962 |
| JP | 59-010284 | 1/1984 |
| JP | 59-112778 | 7/1984 |
| JP | 62-174011 | 11/1987 |
| JP | 5-072777 | 10/1993 |
| JP | 2003-112771 | 4/2003 |
| JP | 2004-42964 | 2/2004 |
| WO | WO 97-41044 | 11/1997 |

OTHER PUBLICATIONS

Supplementary European Search Report issued to EP 0671500.1 on Jun. 5, 2007.

English translation of the International Preliminary Report on Patentability and the Written Opinion of the International Searching Authority for International Application No. PCT/JP2006/303884.

* cited by examiner

PACKAGING MATERIAL AND METHOD OF TRANSPORTING HONEYCOMB STRUCTURED BODY

CROSS-REFERENCE TO RELATED APPLICATIONS

This application is a continuation application of PCT/JP2006/303884 filed on Mar. 1, 2006, which claims priority of Japanese Patent Application No. 2005-165758 filed on Jun. 6, 2005. The contents of these applications are incorporated herein by reference in their entirety.

BACKGROUND OF THE INVENTION

1. Field of the Invention

The present invention relates to a packaging material, in particular, a packaging material to be used upon transporting a honeycomb structured body, and a method of transporting a honeycomb structured body using the packaging material.

2. Discussion of the Background

In recent years, particulates such as soot contained in exhaust gases that are discharged from internal combustion engines of vehicles, such as buses and trucks, and construction machines, have raised serious problems as contaminants harmful to the environment and the human body.

Various ceramic filters using honeycomb structured bodies made from porous ceramics, which collect particulates in exhaust gases to purify the exhaust gases, have been proposed.

More specifically, those filters made from porous ceramics such as silicon carbide and cordierite have been proposed.

In order to avoid such damage to the honeycomb structured body, various packaging materials and holding plates for honeycomb structured bodies have been proposed so as to protect the honeycomb structured body from external impact or the like (for example, see JP-A 2003-112771, JP-A 2004-042964).

The contents of JP-A 2003-112771, JP-A 2004-042964 are incorporated herein by reference in their entirety.

SUMMARY OF THE INVENTION

In accordance with a first aspect of the present invention, a packaging material which comprises a plate member, packages an object to be packaged by sandwiching the object, and the plate member is provided with an installation portion for the object to be packaged, and provided as well with a reinforcing portion.

In the packaging material in accordance with the first aspect of the present invention, the reinforcing portion is preferably formed by forming a groove and/or a concave portion in the plate member.

Moreover, irregularities having a surface roughness Ra of about 0.1 μm or more are preferably formed on the installation portion.

Moreover, irregularities of about 1 mm or more are preferably formed on the installation portion.

The packaging material in accordance with the first aspect of the present invention is preferably formed by molding a plastic sheet.

In the packaging material in accordance with the first aspect of the present invention, the reinforcing portion and the portion other than the reinforcing portion are preferably formed by different materials.

Moreover, the shape of the installation portion is preferably a truncated cone shape.

Moreover, the installation portion is preferably formed by forming a bottomed hole in the plate member.

In the above-mentioned packaging material, the installation area for the object to be packaged in the bottomed hole is preferably smaller than the opening area of the bottomed hole.

Moreover, the bottomed hole preferably has such a shape that, when an object to be packaged is placed therein, a gap is formed between the bottomed hole and the object to be packaged.

Moreover, a raised bottom portion to hold the end face of the object to be packaged is preferably formed on the bottom face of the bottomed hole.

In the packaging material in accordance with the first aspect of the present invention, the object to be packaged is preferably a honeycomb structured body.

A packaging material in accordance with a second aspect of the present invention is a packaging material, which comprises a plate member, packages an object to be packaged by sandwiching the object, and has a structure in which the plate member is provided with an installation portion for the object to be packaged comprising a bottomed hole, and the installation area for the object to be packaged in the bottomed hole is smaller than the opening area of the bottomed hole.

In the packaging material in accordance with the second aspect of the present invention, irregularities having a surface roughness Ra of about 0.1 μm or more are preferably formed on the installation portion.

Moreover, irregularities of about 1 mm or more are preferably formed on the installation portion.

Moreover, the packaging material in accordance with the second aspect of the present invention is preferably formed by molding a plastic sheet.

Moreover, the shape of the installation portion is preferably a truncated cone shape.

In the packaging material in accordance with the second aspect of the present invention, the bottomed hole preferably has such a shape that, when an object to be packaged is placed therein, a gap is formed between the bottomed hole and the object to be packaged.

Moreover, a raised bottom portion to hold the end face of the object to be packaged is preferably formed on the bottom face of the bottomed hole.

In the packaging material in accordance with the second aspect of the present invention, the object to be packaged is preferably a honeycomb structured body.

A packaging material in accordance with a third aspect of the present invention is a packaging material, which comprises a plate member, packages an object to be packaged by sandwiching the object, and has a structure in which the plate member is provided with an installation portion for the object to be packaged comprising a bottomed hole, and the bottomed hole has such a shape that, when an object to be packaged is placed therein, a gap is formed between the bottomed hole and the object to be packaged.

In the packaging material in accordance with the third aspect of the present invention, irregularities having a surface roughness Ra of about 0.1 μm or more are preferably formed on the installation portion.

Moreover, irregularities of about 1 mm or more are preferably formed on the installation portion.

The packaging material in accordance with the third aspect of the present invention is preferably formed by molding a plastic sheet.

Moreover, the shape of the installation portion is preferably a truncated cone shape.

In the packaging material in accordance with the third aspect of the present invention, the installation area for the object to be packaged in the bottomed hole is preferably smaller than the opening area of the bottomed hole.

Moreover, a raised bottom portion to hold the end face of the object to be packaged is preferably formed on the bottom face of the bottomed hole.

In the packaging material in accordance with the third aspect of the present invention, the object to be packaged is preferably a honeycomb structured body.

A packaging material in accordance with a fourth aspect of the present invention is a packaging material, which packages an object to be packaged by sandwiching the object, comprising: a protective member for protecting an end face neighborhood of one of the end faces of the object to be packaged; an installation member in which an installation portion for placing the end face neighborhood of one of the end faces of the object to be packaged is formed; and a holding member in which a through hole that allows penetration of the object to be packaged is formed, and in this structure, the protective member, the installation member and the holding member are configured into an integral unit.

The packaging material in accordance with the fourth aspect of the present invention is preferably formed by bending a cardboard.

Moreover, the packaging material in accordance with the forth aspect of the present invention is preferably formed by plastic.

In the packaging material in accordance with the fourth aspect of the present invention, a notched portion is preferably formed on the periphery of the installation portion.

In the packaging material in accordance with the fourth aspect of the present invention, peripheral side faces are preferably respectively formed between the installation member and the holding member, and between the holding member and the protective member.

Moreover, in the packaging material, a concave portion is preferably formed on the peripheral side faces.

Moreover, in the packaging material, a through hole is preferably formed on the peripheral side faces.

In the packaging material in accordance with the fourth aspect of the present invention, the object to be packaged is preferably a honeycomb structured body.

A packaging material in accordance with a fifth aspect of the present invention is a packaging material used for packaging a pillar-shaped object to be packaged, which comprises: a bottom holding member in which a bottomed hole that houses an end face neighborhood of one of the end faces of the object to be packaged is formed; an upper holding member in which a bottomed hole that houses the end face neighborhood of the other end face of the object to be packaged is formed; and an intermediate holding member in which a through hole that allows penetration of the object to be packaged is formed, and in this structure, the bottom holding member, the upper holding member and the intermediate holding member are configured into an integral unit by using a single sheet member.

The packaging material in accordance with the fifth aspect of the present invention is preferably formed by processing a cardboard.

Moreover, the packaging material in accordance with the fifth aspect of the present invention is preferably formed by plastic.

In the packaging material in accordance with the fifth aspect of the present invention, peripheral side faces are preferably respectively formed on the bottom holding member on the side opposite to the side that is integral with the intermediate holding member, and on the upper holding member on the side opposite to the side that is integral with the intermediate holding member.

Moreover, in the packaging material, a concave portion is preferably formed on the peripheral side face.

In the packaging material in accordance with the fifth aspect of the present invention, the object to be packaged is preferably a honeycomb structured body.

A method of transporting a honeycomb structured body in accordance with a sixth aspect of the present invention comprises housing a honeycomb structured body packaged with a packaging material in a box member, and then transporting the box member, and in this method, the packaging material, which comprises a plate member, packages an object to be packaged by sandwiching the object, and the plate member is provided with an installation portion for the object to be packaged, and provided as well with a reinforcing portion.

In the method of transporting a honeycomb structured body in accordance with the sixth aspect of the present invention, the reinforcing portion is preferably formed by forming a groove and/or a concave portion in the plate member.

Moreover, irregularities having a surface roughness Ra of about 0.1 μm or more are preferably formed on the installation portion.

Moreover, irregularities of about 1 mm or more are preferably formed on the installation portion.

Moreover, the packaging material is preferably formed by molding a plastic sheet.

Moreover, the reinforcing portion and the portion other than the reinforcing portion are preferably formed by different materials.

Moreover, the shape of the installation portion is preferably a truncated cone shape.

Moreover, the installation portion is preferably formed by forming a bottomed hole in the plate member.

In the method of transporting a honeycomb structured body, the installation area for the object to be packaged in the bottomed hole is preferably smaller than the opening area of the bottomed hole.

Moreover, the bottomed hole has such a shape that, when an object to be packaged is placed therein, a gap is preferably formed between the bottomed hole and the object to be packaged.

Moreover, a raised bottom portion to hold the end face of the object to be packaged is preferably formed on the bottom face of the bottomed hole.

In accordance with a seventh aspect of the present invention, a method of transporting a honeycomb structured body comprises housing the honeycomb structured body packaged with a packaging material in a box member, and then transporting the box member, and in this method, the packaging material, which comprises a plate member, is a packaging material for packaging an object to be packaged by sandwiching the object; the plate member is provided with an installation portion for the object to be packaged comprising a bottomed hole; and the installation area for the object to be packaged in the bottomed hole is smaller than the opening area of the bottomed hole.

In the method of transporting a honeycomb structured body in accordance with the seventh aspect of the present invention, irregularities having a surface roughness Ra of about 0.1 μm or more are preferably formed on the installation portion.

Moreover, irregularities of about 1 mm or more are preferably formed on the installation portion.

Moreover, the packaging material is preferably formed by molding a plastic sheet.

Moreover, the shape of the installation portion is preferably a truncated cone shape.

In the method of transporting a honeycomb structured body in accordance with the seventh aspect of the present invention, the bottomed hole has such a shape that, when an object to be packaged is placed therein, a gap is preferably formed between the bottomed hole and the object to be packaged.

Moreover, a raised bottom portion to hold the end face of the object to be packaged is preferably formed on the bottom face of the bottomed hole.

A method of transporting a honeycomb structured body in accordance with an eighth aspect of the present invention comprises housing the honeycomb structured body packaged with a packaging material in a box member, and then transporting the box member, and in this method, the packaging material, which comprises a plate member, is a packaging material for packaging an object to be packaged by sandwiching the object; the plate member is provided with an installation portion for the object to be packaged comprising a bottomed hole; and the bottomed hole has such a shape that, when an object to be packaged is placed therein, a gap is formed between the bottomed hole and the object to be packaged.

In the method of transporting a honeycomb structured body in accordance with the eighth aspect of the present invention, irregularities having a surface roughness Ra of about 0.1 μm or more are preferably formed on the installation portion.

Moreover, irregularities of about 1 mm or more are preferably formed on the installation portion.

Moreover, the packaging material is preferably formed by molding a plastic sheet.

Moreover, the shape of the installation portion is preferably a truncated cone shape.

In the method of transporting a honeycomb structured body in accordance with the eighth aspect of the present invention, the installation area for the object to be packaged in the bottomed hole is preferably smaller than the opening area of the bottomed hole.

Moreover, a raised bottom portion to hold the end face of the object to be packaged is preferably formed on the bottom face of the bottomed hole.

In accordance with a ninth aspect of the present invention, a method of transporting a honeycomb structured body comprises housing the honeycomb structured body packaged with a packaging material in a box member, and then transporting the box member, and in this method, the packaging material is a packaging material for packaging an object to be packaged by sandwiching the object, which comprises: a protective member for protecting an end face neighborhood of one of the end faces of the object to be packaged; an installation member in which an installation portion for placing the end face neighborhood of one of the end faces of the object to be packaged; and a holding member in which a through hole that allows penetration of the object to be packaged is formed, and in this structure, the protective member, the installation member and the holding member are configured into an integral unit.

In the method of transporting a honeycomb structured body in accordance with the ninth aspect of the present invention, the packaging material is preferably formed by bending a cardboard.

Moreover, the packaging material is preferably formed by plastic.

In the method of transporting a honeycomb structured body in accordance with the ninth aspect of the present invention, a notched portion is preferably formed on the periphery of the installation portion in the packaging material.

In the method of transporting a honeycomb structured body in accordance with the ninth aspect of the present invention, peripheral side faces are preferably respectively formed between the installation member and the holding member, and between the holding member and the protective member in the packaging material.

Moreover, a concave portion is preferably formed on the peripheral side face of the packaging material.

Moreover, a through hole is preferably formed on the peripheral side face of the packaging material.

In accordance with a tenth aspect of the present invention, a method of transporting a honeycomb structured body comprises housing the honeycomb structured body packaged with a packaging material in a box member, and then transporting the box member, and in this method, the packaging material is a packaging material for packaging a pillar-shaped object to be packaged, which comprises: a bottom holding member in which a bottomed hole that houses the proximate portion of one of the end faces of the object to be packaged is formed; an upper holding member in which a bottomed hole that houses an end face neighborhood of the other end face of the object to be packaged is formed; and an intermediate holding member in which a through hole that allows penetration of the object to be packaged is formed, and in this structure, the bottom holding member, the upper holding member and the intermediate holding member are configured into an integral unit by using a single sheet member.

In the method of transporting a honeycomb structured body in accordance with the tenth aspect of the present invention, the packaging material is preferably formed by processing a cardboard.

Moreover, the packaging material is preferably formed by plastic.

In the method of transporting a honeycomb structured body in accordance with the tenth aspect of the present invention, peripheral side faces are preferably respectively formed on the bottom holding member on the side opposite to the side that is integral with the intermediate holding member, and on the upper holding member on the side opposite to the side that is integral with the intermediate holding member in the packaging material.

Moreover, a concave portion is preferably formed on the peripheral side face of the packaging material.

DESCRIPTION OF THE EMBODIMENTS

Figure 1A:
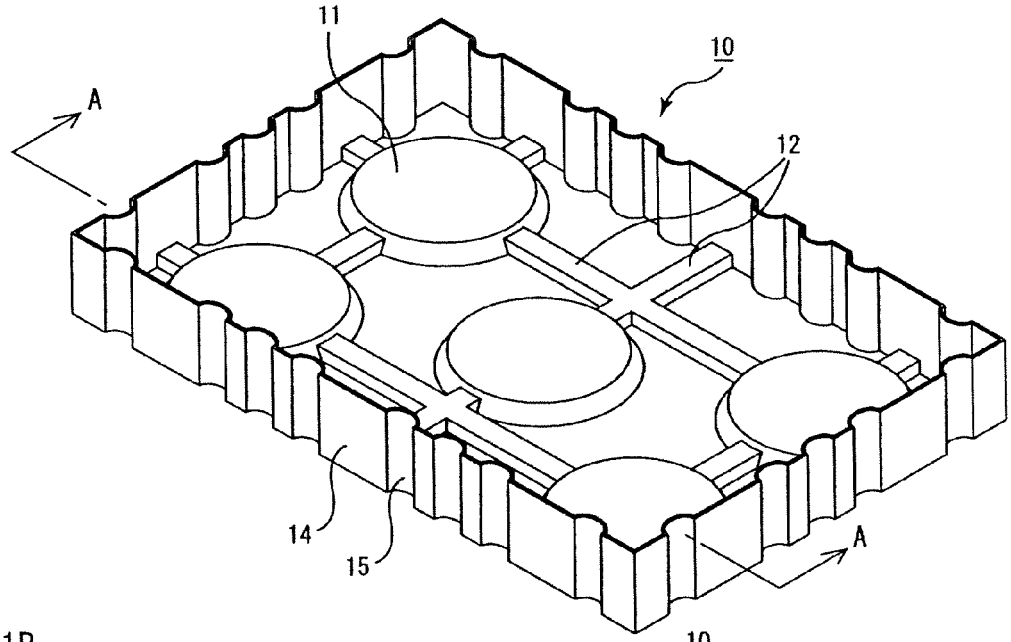
FIG. 1A is a perspective view that schematically shows one example of a packaging material in accordance with one embodiment of the first aspect of the present invention.

The packaging material according to the first aspect of the present invention, which comprises a plate member, packages an object to be packaged by sandwiching the object, and the above-mentioned plate member is provided with an installation portion for the object to be packaged and provided as well with a reinforcing portion.

The packaging material in accordance with the embodiment of the second aspect of the present invention is a packaging material comprising a plate member, which packages an object to be packaged by sandwiching the object, and the plate member is provided with an installation portion for the object to be packaged comprising a bottomed hole, and the installation area for the object to be packaged in the bottomed hole is made smaller than the opening area of the bottomed hole.

The packaging material in accordance with the embodiment of the third aspect of the present invention is a packaging material comprising a plate member, which packages an object to be packaged by sandwiching the object, and the plate member is provided with installation portions for objects to be packaged comprising a bottomed hole, and the bottomed hole has such a shape that, when an object to be packaged is placed therein, a gap is formed between the bottomed hole and the object to be packaged.

The packaging material in accordance with the embodiment of the fourth aspect of the present invention is a packaging material, which packages an object to be packaged by sandwiching the object, and comprises: a protective member for protecting an end face neighborhood of one of the end faces of the object to be packaged; an installation member in which an installation portion for placing the end face neighborhood of one of the end faces of the object to be packaged is formed; and a holding member in which a through hole that allows penetration of the object to be packaged is formed, and in this structure, the protective member, the installation member and the holding member are configured into an integral unit.

The packaging material in accordance with the embodiment of the fifth aspect of the present invention, which is used for packaging a pillar-shaped object to be packaged, comprises: a bottom holding member in which a bottomed hole that houses an end face neighborhood of one of the end faces of the object to be packaged is formed; an upper holding member in which a bottomed hole that houses the end face neighborhood of the other end face of the object to be packaged is formed; and an intermediate holding member in which a through hole that allows penetration of the object to be packaged is formed, and in this structure, the bottom holding member, the upper holding member and the intermediate holding member are configured into an integral unit by using a single sheet member.

In accordance with the packaging materials of the embodiments of the first to fifth aspects of the present invention, the packaging material tends not to bend even upon receipt of an externally applied impact or the like. Consequently, damage such as cracks tends not to occur in an object to be packaged that has been packaged by this packaging material. Thus, it may become easier to reduce the rate of occurrence of the damage at the time of transporting the packaged object.

The method of transporting a honeycomb structured body in accordance with the embodiment of the sixth aspect of the present invention comprises housing a honeycomb structured body packaged with a packaging material in a box member, and then transporting the box member, and in this method, the packaging material, which comprises a plate member, packages an object to be packaged by sandwiching the object, and the plate member is provided with an installation portion for the object to be packaged, and provided as well with a reinforcing portion.

The method of transporting a honeycomb structured body in accordance with the embodiment of the seventh aspect of the present invention comprises housing the honeycomb structured body packaged with a packaging material in a box member, and then transporting the box member, and in this method, the packaging material, which comprises a plate member, is a packaging material for packaging an object to be packaged by sandwiching the object; the plate member is provided with an installation portion for the object to be packaged comprising a bottomed hole; and the installation area for the object to be packaged in the bottomed hole is smaller than the opening area of the bottomed hole.

The method of transporting a honeycomb structured body in accordance with the embodiment of the eighth aspect of the present invention comprises housing the honeycomb structured body packaged with a packaging material in a box member, and then transporting the box member, and in this method, the packaging material, which comprises a plate member, is a packaging material for packaging an object to be packaged by sandwiching the object; the plate member is provided with an installation portion for the object to be packaged comprising a bottomed hole; and the bottomed hole has such a shape that, when an object to be packaged is placed therein, a gap is formed between the bottomed hole and the object to be packaged.

The method of transporting a honeycomb structured body in accordance with the embodiment of the ninth aspect of the present invention comprises housing the honeycomb structured body packaged with a packaging material in a box member, and then transporting the box member, and in this method, the packaging material is a packaging material for packaging an object to be packaged by sandwiching the object, which comprises: a protective member for protecting an end face neighborhood of one of the end faces of the object to be packaged; an installation member in which an installation portion for placing the end face neighborhood of one of the end faces of the object to be packaged; and a holding member in which a through hole that allows penetration of the object to be packaged is formed, and in this structure, the protective member, the installation member and the holding member are configured into an integral unit.

The method of transporting a honeycomb structured body in accordance with the embodiment of the tenth aspect of the present invention comprises housing the honeycomb structured body packaged with a packaging material in a box member, and then transporting the box member, and in this method, the packaging material is a packaging material for packaging a pillar-shaped object to be packaged, which comprises: a bottom holding member in which a bottomed hole that houses the proximate portion of one of the end faces of the object to be packaged is formed; an upper holding member in which a bottomed hole that houses an end face neighborhood of the other end face of the object to be packaged is formed; and an intermediate holding member in which a through hole that allows penetration of the object to be packaged is formed, and in this structure, the bottom holding member, the upper holding member and the intermediate holding member are configured into an integral unit by using a single sheet member.

In accordance with the methods of transporting a honeycomb structured body of the embodiments of the sixth to tenth aspects of the present invention, even when a box member in which a honeycomb structured body packaged with the packaging material has been housed receives an impact or the like from the outside, the packaging material tends not to bend. Consequently, damage such as cracks tends not to occur in the honeycomb structured body that has been packaged with this packaging material. Thus, it may become easier to reduce the rate of occurrence of the damage at the time of transporting the honeycomb structured body.

The following description will briefly discuss preferable embodiments of the packaging material in accordance with the first aspect of the present invention, and the reasons to support the embodiments.

First, in the packaging material in accordance with the embodiment of the first aspect of the present invention, the reinforcing portion is desirably formed by installing grooves and/or concave portions in the plate member.

The structure in which the grooves and/or concave portions that function as reinforcing portions are formed on the plate member in this manner makes the manufacturing process easier and is economically advantageous, in comparison with the structure of a packaging material (for example, see FIGS. 4A and 4B, etc.) in which a reinforcing portion, made of a material different from the plate member, is manufactured and secured thereto.

Moreover, in the packaging material in accordance with the embodiment of the first aspect of the present invention, the installation portion is desirably constructed by forming a bottomed hole in the plate member.

In the case where the installation portion is constructed by forming a bottomed hole, it becomes possible to more surely package the honeycomb structured body to be packaged.

In the packaging material in accordance with the embodiment of the first aspect of the present invention, the installation area for an object to be packaged in the bottomed hole is preferably made smaller than the opening area of the bottomed hole.

In the case where the bottomed hole is formed into this shape, the occurrence of damage, such as breakage and cracks, on the end portion and side face of the honeycomb structured body tends to be reduced.

In the packaging material in accordance with the embodiment of the first aspect of the present invention, the bottomed hole is preferably formed into such a shape that, when an object to be packaged is installed, a gap is formed between the bottomed hole and the object to be packaged.

In the case where the bottomed hole is formed into this shape, the occurrence of damages, such as breakage and cracks, on the end portion and side face of the honeycomb structured body tends to be reduced.

Referring to the drawings, the following description will discuss the embodiments of a packaging material according to the first to fifth aspects of the present invention.

Here, the packaging material of the present invention will be explained by taking an example of the case where a honeycomb structured body is used as an object to be packaged; however, the object which can be packaged with the packaging material of the present invention is not limited to the honeycomb structured body.

Referring to the drawings, the following description will discuss a specific embodiment of the packaging material in accordance with the embodiment of the first aspect of the present invention. However, the specific embodiment of the packaging material according to the embodiment of the first embodiment of the present invention is not limited to the embodiments shown in the drawings.

Figure 1B:
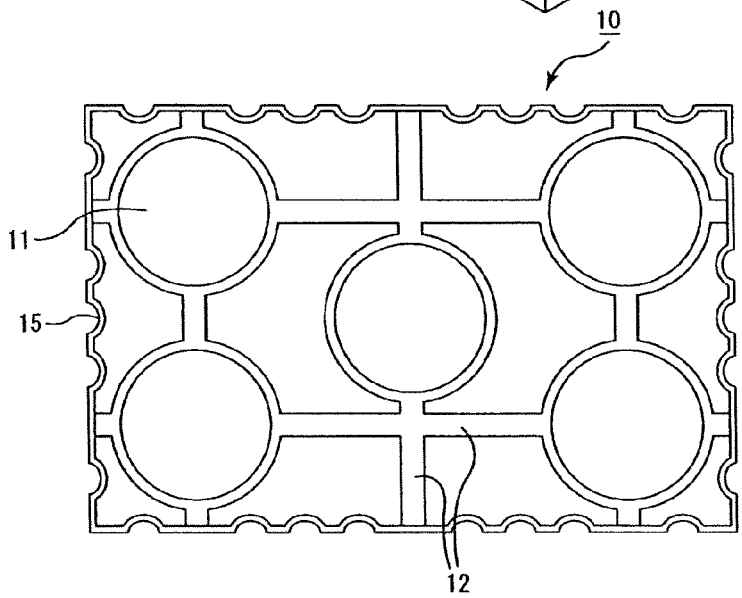
FIG. 1B is a plan view showing the packaging material shown in FIG. 1A.
Figure 1C:
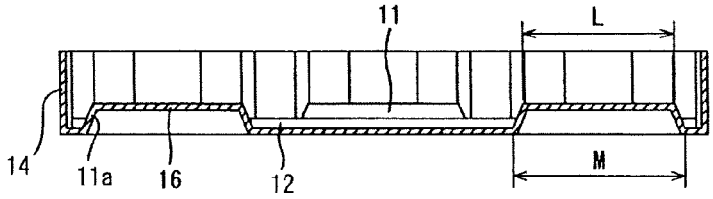
FIG. 1C is a cross-sectional view taken along line A-A of the packaging material of FIG. 1A.

FIG. 1A is a perspective view that schematically shows one example of a packaging material in accordance with the embodiment of the first aspect of the present invention, FIG. 1B is a plan view showing the packaging material shown in FIG. 1A, and FIG. 1C is a cross-sectional view taken along line A-A of the packaging material shown in FIG. 1A.

Figure 2A:
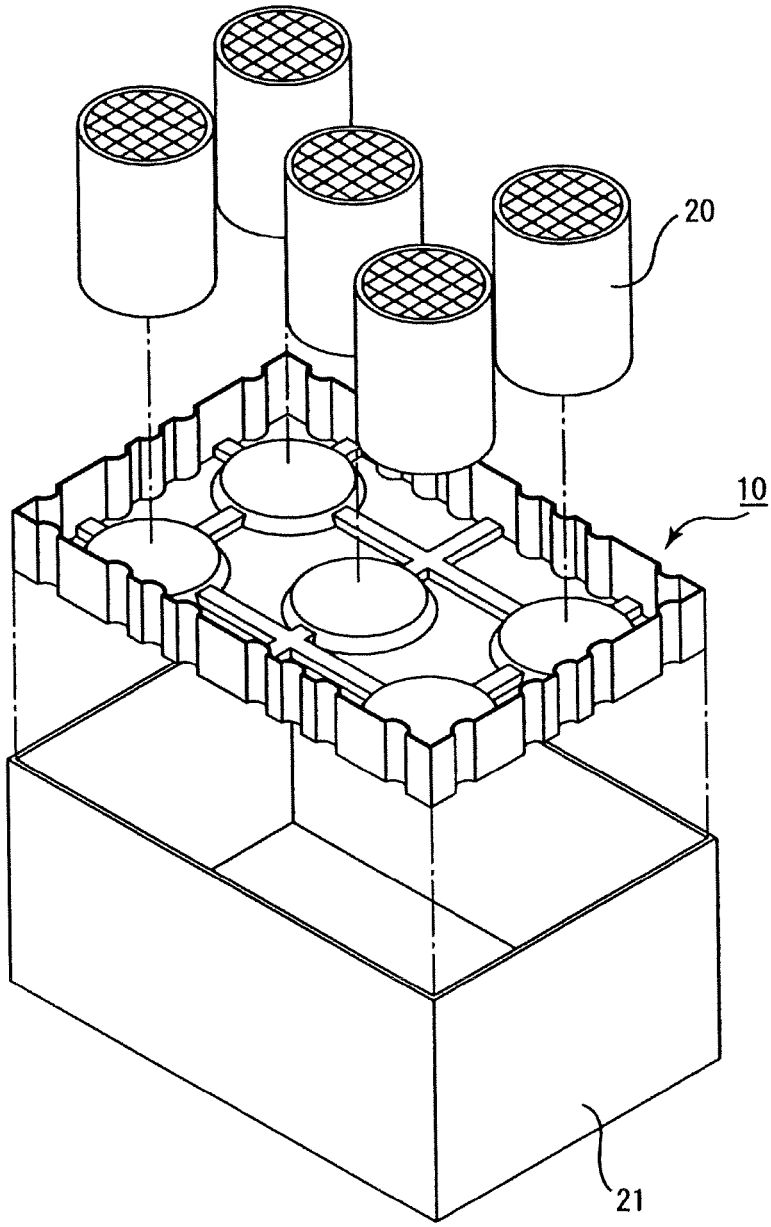
FIG. 2A is an exploded perspective view that explains one embodiment in which a honeycomb structured body is packaged with a packaging material 10 shown in FIGS. 1A, 1B and 1C, and further housed in a box member.
Figure 2B:
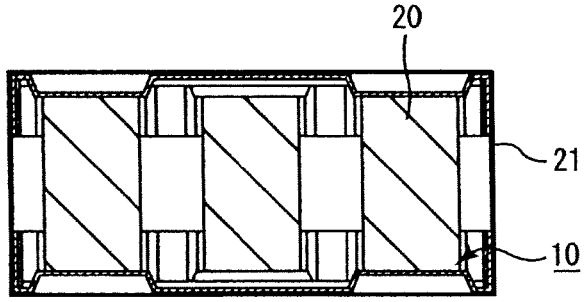
FIG. 2B is a cross-sectional view of the embodiment shown in FIG. 2A.

FIG. 2A is an exploded perspective view that explains an embodiment in which a honeycomb structured body is packaged with a packaging material 10 shown in FIGS. 1A, 1B and 1C, and further housed in a box member, and FIG. 2B is a cross-sectional view of the embodiment shown in FIG. 2A.

The packaging material 10, shown in FIGS. 1A, 1B and 1C, is a packaging material formed by molding a plastic sheet, and has a structure in which an installation portion 11 used for installing the end face neighborhood of an object to be packaged (honeycomb structured body) is formed on its upper face and a plurality of reinforcing portions (installation face reinforcing portions) 12 are secured to a part of the area where no installation portion 11 is formed. Here, the reinforcing portions 12 are secured in such a manner that, when each of them crosses the other reinforcing portion, the two portions are orthogonal to each other.

A peripheral side face portion 14, formed by bending the plastic sheet upward, is formed on the peripheral portion of the packaging material 10, and a plurality of grooves 15 are formed in the peripheral side face portion 14. Here, the grooves 15 are also allowed to function as reinforcing portions (side face reinforcing portions).

The installation portion 11 is formed in such a manner that the diameter (upper face diameter) of the upper face portion is made smaller than the diameter of the end face of the honeycomb structured body, and a side face 11*a* thereof is formed in a tapered shape with its diameter increasing toward the bottom face.

The installation portion 11 is formed in a size that holds only one portion of the end face of the honeycomb structured body. In other words, the diameter of the upper face (indicated by L in FIG. 1C) of the installation portion 11 is made shorter than the diameter of the end face of the honeycomb structured body.

Upon packaging a honeycomb structured body 20 by using the packaging material 10, as shown in FIG. 2A, the end face neighborhood of the honeycomb structured body 20 is placed on the installation portion 11, and the packaging material 10 in which the honeycomb structured body 20 has been packaged is housed in the box member 21.

Here, when housed in the box member 21, not only the lower side of the honeycomb structured body 20, but also the upper side thereof is packaged with the packaging materials (see FIG. 2B).

In other words, the end face neighborhood of the honeycomb structured body 20 on the upper side is held by the packaging material 10 in its upside down state.

Here, FIG. 2A shows only the packaging material for the lower side of the honeycomb structured body, while FIG. 2B shows a state in which the upper and lower sides of the honeycomb structured body are packaged with the packaging materials.

When the side faces of the upper and lower packaging materials are aligned with each other in the box, it may become easier to prevent deformation of the packaging materials more surely.

The upper face diameter (indicated by L in FIG. 1C) and the bottom diameter (indicated by M in FIG. 1C) of the installation portion 11 are determined by the diameter of the end face of the honeycomb structured body, and the upper face diameter is preferably shorter than the diameter of the end face of the honeycomb structured body by at least about 2 mm and at most about 40 mm, while the bottom diameter is preferably longer than the diameter of the end face of the honeycomb structured body by at least about 5 mm and at most about 20 mm.

Moreover, although not particularly limited, the height of the installation portion 11 is at least about 1 mm and at most about 10 mm when packaging a honeycomb structured body having a diameter of 145 mm and a length of 150 mm, for example.

Figure 6A:
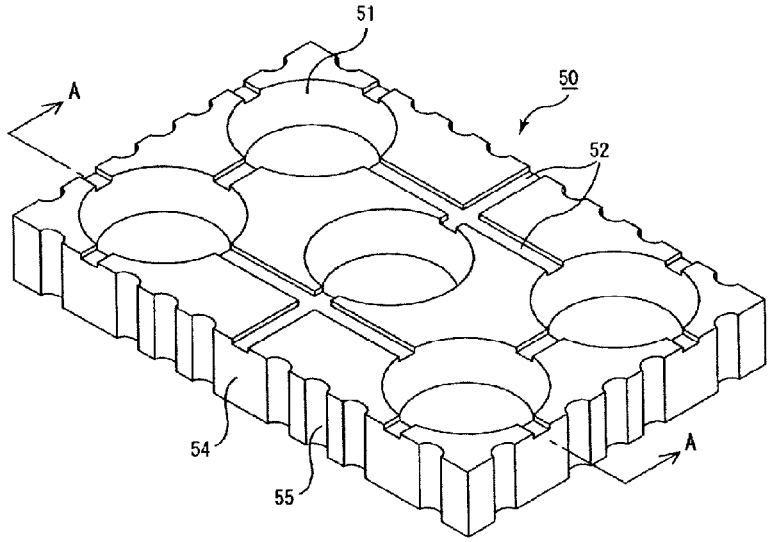
FIG. 6A is a perspective view that schematically shows still another example of a packaging material in accordance with one embodiment of the first aspect of the present invention.
Figure 6B:
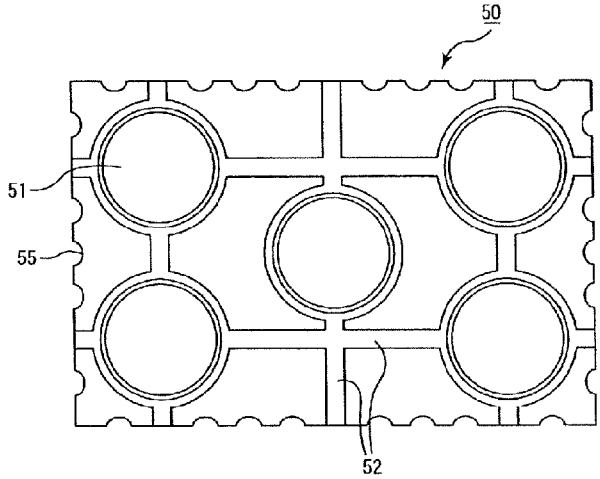
FIG. 6B is a plan view showing the packaging material shown in FIG. 6A.
Figure 6C:
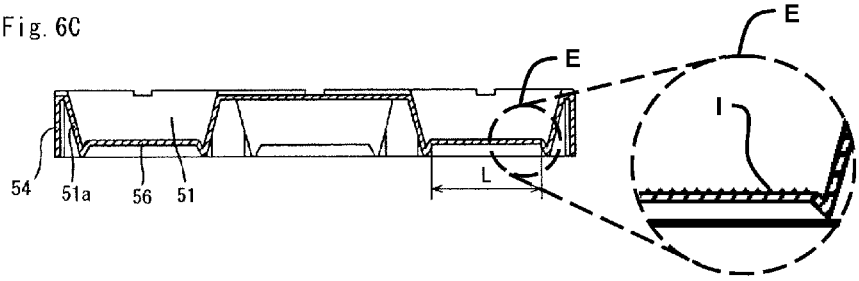
FIG. 6C is a cross-sectional view taken along line A-A of the packaging material of FIG. 6A and includes an enlarged area E.

Irregularities may be formed on the installation portion 11 (see, e.g., irregularities I on installation portion 56 in enlarged area E in FIG. 6C). For example, when the irregularities having a surface roughness Ra of about 0.1 μm or more are formed, the coefficient of friction between an object to be packaged and the installation portion can be increased so that displacement (slippage) of the object to be packaged tends to be prevented. Moreover, when irregularities of about 1 mm or more (for example, grooves or the like) are formed thereon, a function of preventing deformation of the installation portion itself tends to be rendered thereto.

In the packaging material 10, reinforcing portions 12 are formed at an area of the installation face where the installation portions 11 are not formed.

The formation of such reinforcing portions 12 may make it easier to prevent the packaging material 10 from being bent at the time of transportation or the like, and consequently to prevent the honeycomb structured body from being damaged.

Here, as shown in FIGS. 1A, 1B and 2A, the reinforcing portions 12 are preferably formed in such a manner that, when each reinforcing portions 12 intersects with another reinforcing portion 12, those reinforcing portions are orthogonal to each other. When the reinforcing portions 12 are formed so as to be orthogonal to each other, the strength of the packaging material is improved so that it may become easier to surely prevent the packaging material from being bent.

Here, in the packaging material shown in FIGS. 1A, 1B, 1C, 2A and 2B, the installation portions and reinforcing portions are formed by molding the plastic sheet; that is, the entire portion is formed by the same material, and on the other hand, in the packaging material according to the embodiment of the first aspect of the present invention, a base portion (the portion other than the reinforcing portions) may be formed by molding the plastic sheet or the like, and the reinforcing portions may be formed by using another material (see FIGS. 4A, 4B, 5A and 5B).

Upon forming the reinforcing portions by using another material, the reinforcing portions may be formed by using a material that is comparatively more resistant against deformation than a material constituting the base portion, and specific examples of the material include: wood, metal, cardboard, styrofoam, and the like. Plastics may be used as the material for the reinforcing portions, and in this case, plastic materials of a kind that are highly resistant against deformation are preferably used.

A peripheral side face portion 14 is formed on the peripheral portion of the packaging material 10.

By forming the peripheral side face portion 14, the contact area between the packaging material 10 and the inner face of the box member 21 is increased when the packaging material 10 is housed in the box member 21, therefore, the risk of displacement or bending of packaging material 10 inside the box member is decreased, and consequently damage is less likely to occur in the honeycomb structured body.

Moreover, grooves (side face reinforcing portions) 15, which function as reinforcing portion, are formed in the peripheral side face portion 14; thus, the formation of these grooves 15 further increases the strength of the peripheral side face portion 14, therefore, displacement or bending of the packaging material is further less likely to occur. Here, the grooves 15 of the peripheral side face portion 14 may be formed on demand.

In the packaging material 10, the grooves 15 are formed on the peripheral side face as the reinforcing portions; however, in place of the grooves 15, concave portions may be formed on the peripheral side face. Moreover, in the packaging material 10, in place of the grooves 15 and the concave portions, reinforcing members, made of wood, metal, plastics, cardboard, styrofoam or the like, may be secured to the positions in the peripheral side face corresponding to positions for the grooves and concave portions so that the reinforcing portions may be formed. Here, in the packaging material of the present invention, with respect to the grooves and concave portions on the peripheral side face, the grooves refer to those grooves formed over the entire peripheral side face in the height direction (see FIGS. 1A and 1B), and the concave portions refer to those concave portions formed only on a part of the peripheral side face in the height direction (see FIG. 5B).

Moreover, in the packaging material 10 shown in FIGS. 1A, 1B and 1C, the shape of the installation portion 11 is a truncated cone shape; however, in the packaging material according to the first aspect of the present invention, the shape of the installation portion is not limited to the truncated cone shape.

Figure 3A:
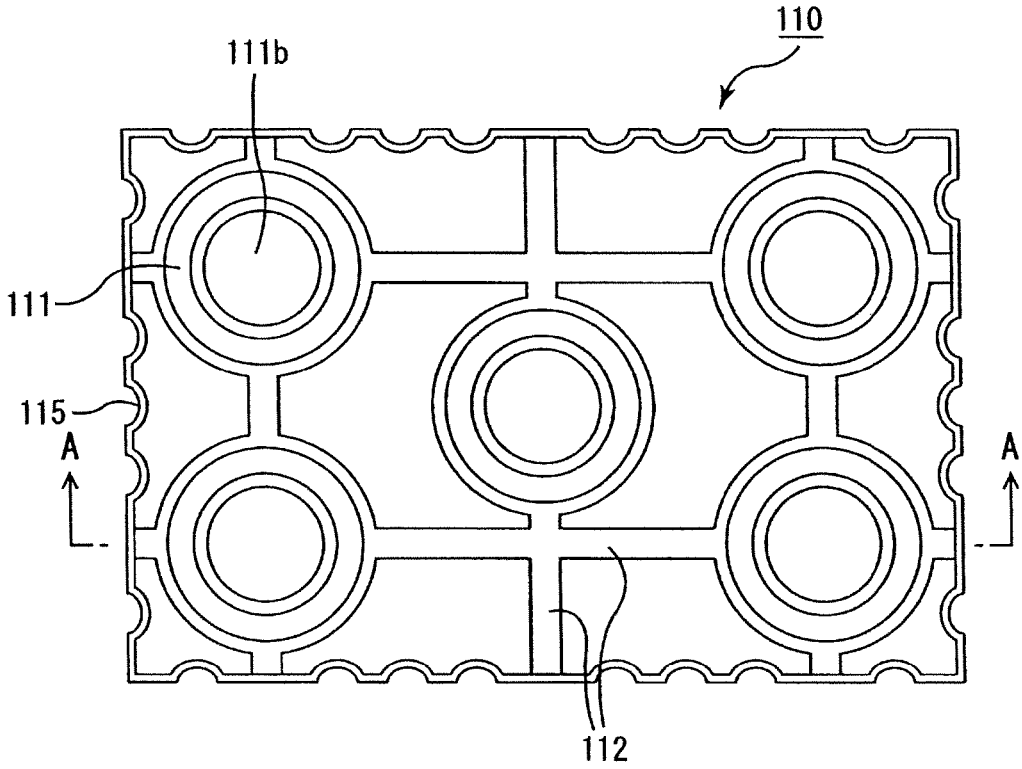
FIG. 3A is a plan view that schematically shows another example of a packaging material in accordance with one embodiment of the first aspect of the present invention.
Figure 3B:
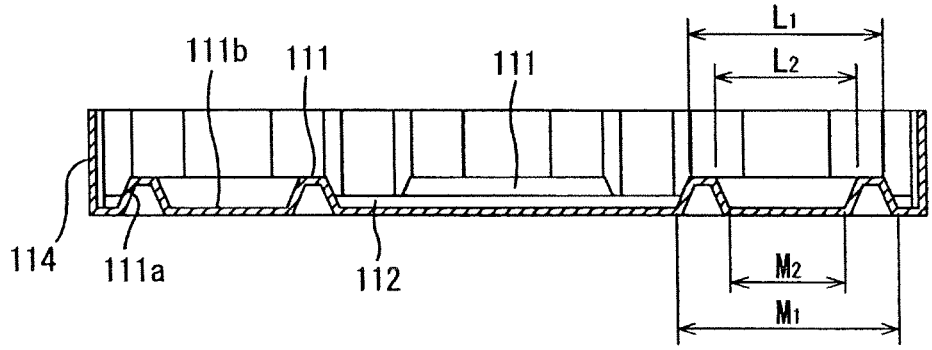
FIG. 3B is a cross-sectional view taken along line A-A of the packaging material shown in FIG. 3A.

FIG. 3A is a plan view that schematically shows another example of the packaging material in accordance with the embodiment of the first aspect of the present invention, and FIG. 3B is a cross-sectional view taken along line A-A of the packaging material shown in FIG. 3A.

The installation portion 111 of the packaging material 110 shown in FIGS. 3A and 3B is formed in such a manner that the outer diameter of the upper face is made smaller than the diameter of the end face of the honeycomb structured body, and a concave portion 111*b* is formed in the center of a truncated cone shape in which the outer side face 111*a* is formed into a tapered shape with the diameter increasing toward the bottom face.

In the case also of the installation portion having this structure, since the contact area between the end face of the honeycomb structured body and the installation portion tends to be made smaller, it is possible to reduce the occurrence of damage and the like in the honeycomb structured body.

Here, the shape of the packaging material 110 shown in FIGS. 3A and 3B is the same as that of the packaging material 10 shown in FIGS. 1A, 1B and 1C, except that the shape of the installation portion 111 is different; therefore, the description thereof is omitted.

The packaging material in accordance with the embodiment of the first aspect of the present invention may have shapes, for example, as shown in FIGS. 4A, 4B, 5A and 5B.

Figure 4A:
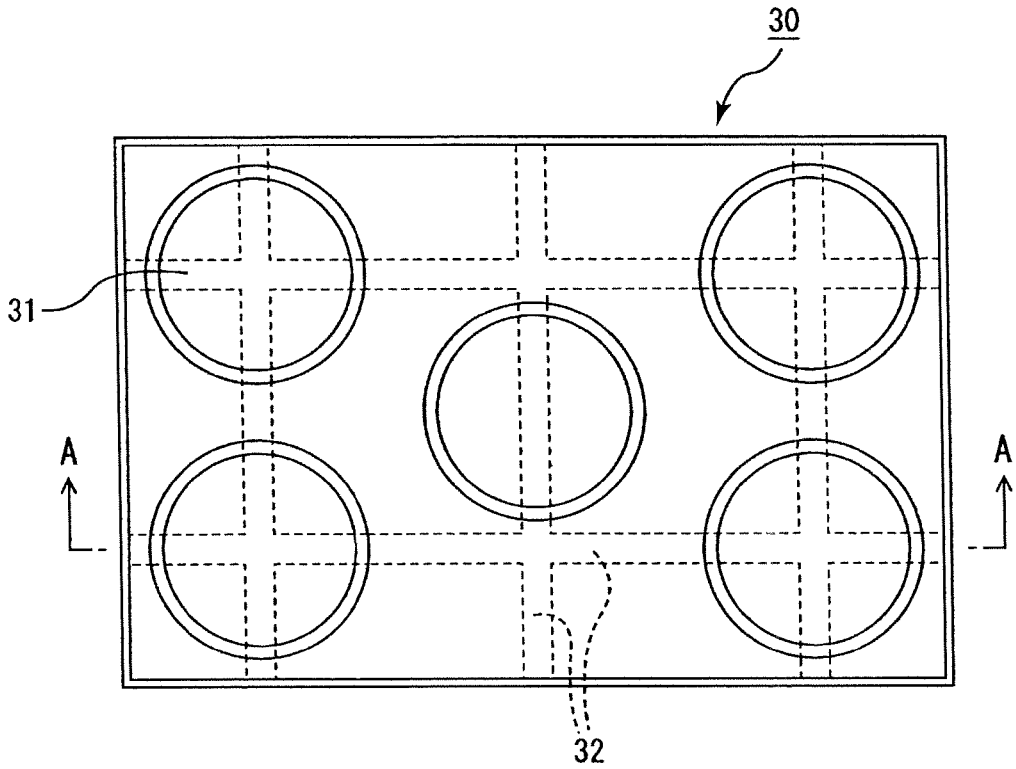
FIG. 4A is a plan view that schematically shows another example of a packaging material in accordance with one embodiment of the first aspect of the present invention.
Figure 4B:
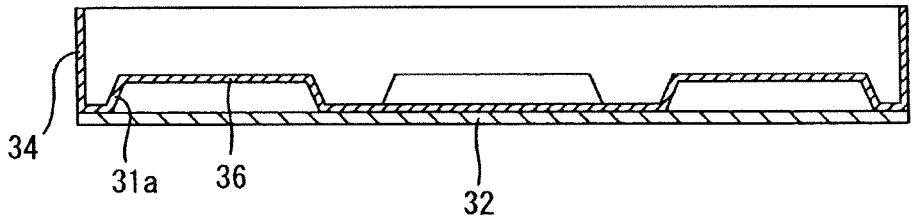
FIG. 4B is a cross-sectional view taken along line A-A of the packaging material of FIG. 4A.
Figure 5A:
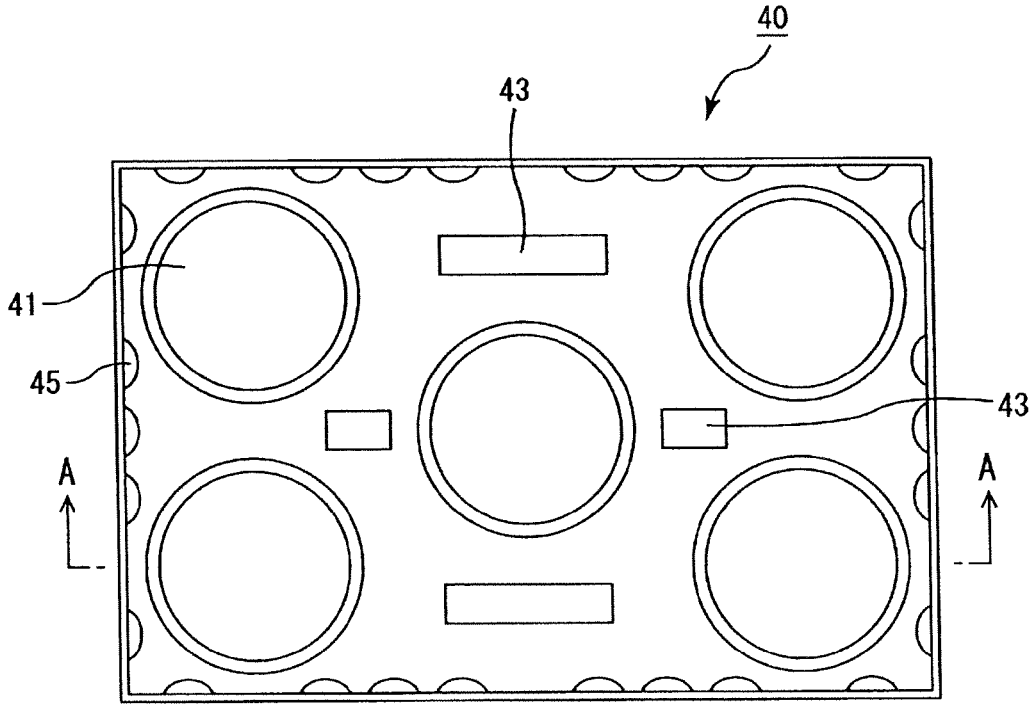
FIG. 5A is a plan view that schematically shows still another example of a packaging material in accordance with one embodiment of the first aspect of the present invention.
Figure 5B:
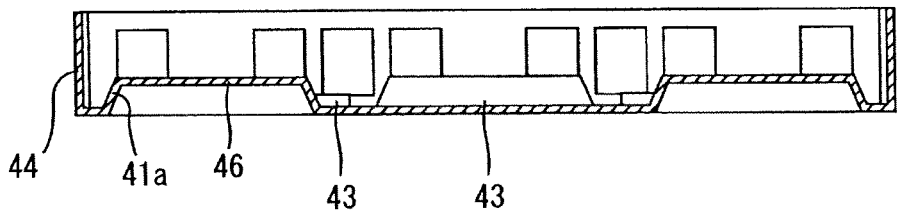
FIG. 5B is a cross-sectional view taken along line A-A of the packaging material of FIG. 5A.

FIGS. 4A and 5A are plan views that schematically show other examples of the packaging material in accordance with the embodiment of the first aspect of the present invention, and FIGS. 4B and 5B are cross-sectional views taken along line A-A of the packaging materials shown in FIGS. 4A and 5A, respectively.

The packaging material 30, shown in FIGS. 4A and 4B, is a packaging material formed by molding a plastic sheet, and has a structure in which an installation portion 31 used for installing the end face neighborhood of an object to be packaged (honeycomb structured body) is formed on its upper face.

Moreover, a plurality of reinforcing portions (installation face reinforcing portions) 32 are secured to a part of a face opposite to the face on which the installation portion 31 of a plastic sheet is formed. Here, the reinforcing portions 32 are formed in such a manner that when each of them crosses the other reinforcing portion, the two portions are orthogonal to each other.

A peripheral side face 34, formed by bending a plastic sheet upward, is formed on the peripheral portion of the packaging material 30.

The embodiment of the peripheral side face 34 of the packaging material 30 shown in FIGS. 4A and 4B is the same as that of the packaging material 10 shown in FIGS. 1A, 1B and 1C, except that no grooves serving as reinforcing portions are formed thereon.

The use of the packaging material 30 also tends to prevent displacement and bending of the packaging material at the time when a honeycomb structured body is packaged, housed in a box member, and transported or the like, and consequently to prevent the honeycomb structured body from being, for example, damaged.

Here, in the packaging material 30, the shape of the installation portion 31 is the same as that in the aforementioned packaging material 10; therefore, the description thereof is omitted.

The packaging material 40 shown in FIGS. 5A and 5B is a packaging material formed by molding a plastic sheet, and has a structure in which installation portions 41, each used for installing the end face neighborhood of an object to be packaged (honeycomb structured body), are formed on its upper face, and a plurality of reinforcing portions (installation face reinforcing portions) 43 are secured to a part of an area where no installation portions 41 are formed, on the same face on which the installation portions 41 have been formed.

A peripheral side face 44, formed by bending a plastic sheet upward, is formed on the peripheral portion of the packaging material 40, and a plurality of concave portions 45 are formed on the peripheral side face 44. Here, the concave portions 45 are also allowed to function as reinforcing portions.

The embodiment of the packaging material 40 shown in FIGS. 5A and 5B is the same as that of the packaging material 10 shown in FIGS. 1A, 1B and 1C, except that the shape of the reinforcing members 43 is different.

The reinforcing portions 43 have a function of preventing the packaging material 30 from being bent, in the same manner as in the reinforcing portions 12 formed in the packaging material 10.

Moreover, the use of the packaging material 40 also tends to prevent displacement and bending of the packaging material at the time when the honeycomb structured body is packaged, housed in the box member and transported, and consequently to prevent the honeycomb structured body from being, for example, damaged.

Here, in the packaging material 40, the shape of the installation portion 41 is the same as that of the aforementioned packaging material 10; therefore, the description thereof is omitted.

Moreover, in the packaging material in accordance with the embodiment of the first aspect of the present invention, each of the above-mentioned installation portions may be formed by forming a bottomed hole in the plate member.

In this case, the installation area for the object to be packaged in the bottomed hole is desirably smaller than the opening area of the bottomed hole. Moreover, the bottomed hole is preferably formed into a shape in which, when the object to be packaged is placed thereon, a gap G is formed between the bottomed hole and the object to be packaged, for example as shown in enlarged area F in FIG. 7B.

FIG. 6A is a perspective view that schematically shows another example of a packaging material in accordance with the embodiment of the first aspect of the present invention, FIG. 6B is a plan view showing the packaging material shown in FIG. 6A, and FIG. 6C is a cross-sectional view taken along line A-A of the packaging material of FIG. 6A.

Figure 7A:
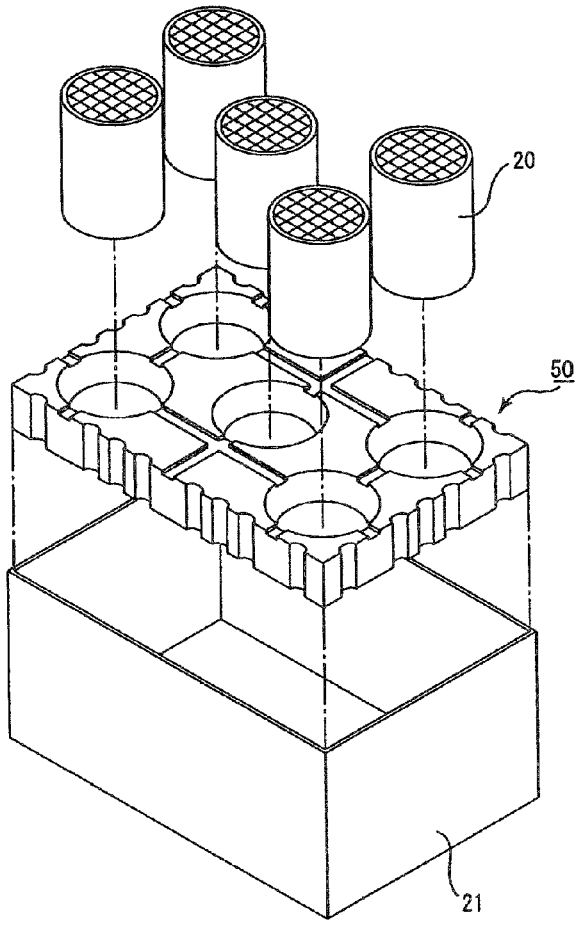
FIG. 7A is an exploded perspective view that explains one embodiment in which a honeycomb structured body is packaged with a packaging material 50 shown in FIGS. 6A, 6B and 6C, and further housed in a box member.
Figure 7B:
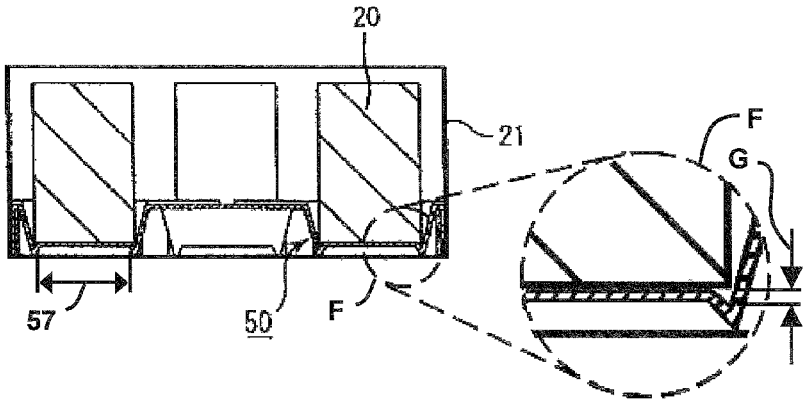
FIG. 7B is a cross-sectional view of the embodiment shown in FIG. 7A and includes an enlarged area F.

FIG. 7A is an exploded perspective view that explains an embodiment in which a honeycomb structured body is packaged with a packaging material 50 shown in FIG. 6A and further housed in a box member, and FIG. 7B is a cross-sectional view of the embodiment shown in FIG. 7A.

The packaging material 50 shown in FIGS. 6A, 6B and 6C is a packaging material formed by molding a plastic sheet, and has a structure in which bottomed holes 51, each used for installing the end face neighborhood of an object to be packaged (honeycomb structured body), are formed on its upper face, and a plurality of grooves (installation face reinforcing portions) 52 are secured to a part of an area where no bottomed hole 51 is formed. Here, the grooves 52 are secured in such a manner that when each of them crosses another groove, the two grooves are orthogonal to each other.

A peripheral side face 54, formed by bending a plastic sheet downward, is formed on the peripheral portion of the packaging material 50, and a plurality of grooves (side face reinforcing portions) 55 are formed on the peripheral side face 54. Here, in the packaging material 50, the grooves 52 and 55 are also allowed to function as reinforcing portions.

Each bottomed holes 51 is formed in such a manner that the diameter of the opening portion is larger than the diameter of the end face of a honeycomb structured body, and its side face 51*a* is formed into a tapered shape having the diameter decreasing toward the bottom face, and a raised bottom portion (installation portion) 56, which holds the end face of the honeycomb structured body, is formed on the bottom face.

The raised bottom portion 56 is shaped into a size that supports only a part of the end face of the honeycomb structured body. In other words, the diameter of the upper face (indicated by L in FIG. 6C) of the raised bottom portion 56 is shorter than the diameter of the end face of the honeycomb structured body.

As described above, in the packaging material 50, the installation area 57 for the honeycomb structured body in the bottomed hole 51 is smaller than the opening area of the bottomed hole 51, and in the packaging material 50 having such bottomed holes 51, it may become possible for only a part of the end face of the honeycomb structured body to be made in contact with the installation portion so that damage is far less likely to occur in the honeycomb structured body at the time of a transporting process or the like. For example, as shown in the enlarged area F in FIG. 7B, the bottomed hole has such a shape that, when the honeycomb structured body is placed therein, a gap G is formed between the bottomed hole and the honeycomb structured body.

Upon packaging a honeycomb structured body 20 by using the packaging material 50, as shown in FIGS. 7A and 7B, the end face neighborhood of the honeycomb structured body is housed in each bottomed holes 51, and the packaging material 50 in which the honeycomb structured body 20 has been packaged is housed in the box member 21.

Here, although not shown in FIGS. 7A and 7B, when housed in the box member 21, normally, not only the lower side of the honeycomb structured body 20, but also the upper side thereof is packaged with the packaging material.

In other words, the end face neighborhood of the honeycomb structured body 20 on the upper side is held by the packaging material 50 in its upside down state.

In the packaging material 50, the raised bottom portion 56 is formed on the bottom face of each bottomed hole 51. As shown in FIGS. 7A and 7B, at the time of a transporting or the like of the packaging material 50 and the honeycomb structured body 20, both housed in the box member 21, the formation of such a raised bottom portion 56 may make it easier to prevent the honeycomb structured body from being damaged due to impact from below.

The opening diameter and the bottom diameter of the bottomed hole 51 are determined according to the diameter of the end face of the honeycomb structured body, and the opening diameter is preferably made longer than the diameter of the end face of the honeycomb structured body by at least about 5 mm and at most about 20 mm, while the bottom diameter is preferably made shorter than the diameter of the end face of the honeycomb structured body by at least about 2 mm and at most about 10 mm.

Moreover, although not particularly limited, the depth of the bottomed hole 51 and the raised height of the raised bottom portion 56 are set to at least about 20 mm and at most about 50 mm and to at least about 1 mm and at most about 10 mm, respectively, in the case where, for example, a honeycomb structured body having ϕ145 mm and a length of 150 mm is packaged.

Here, the upper face diameter (L in FIG. 6C) of the raised bottom portion 56 may be applicable as long as it is shorter than the diameter of the end face of the honeycomb structured body, and by ordinary, it is desirably shorter by at least about 5 mm and at most about 40 mm.

Grooves 52 are formed in an area of the packaging material 50 where no bottomed hole 51 is formed. The formation of these grooves 52 may make it easier to prevent the packaging material 50 from being bent at the time of transporting or the like, and consequently to prevent the honeycomb structured body from being damaged.

Here, as shown in FIG. 6B, the grooves 52 are preferably formed in such a manner that when each of them crosses another groove, the two grooves are orthogonal to each other. When the grooves 52 are formed so as to be orthogonal to each other in this manner, the strength of the packaging material is improved so that it may become easier to surely prevent the packaging material from being bent.

A peripheral side face 54 is formed on the peripheral portion of the packaging material 50.

By forming the peripheral side face 54, the contact area between the packaging material 50 and the inner face of the box member 21 tends to be increased when the packaging material 50 is housed in the box member 21, thereby making it possible to prevent the packaging material 50 from being displaced or bent inside the box member, and consequently damage becomes less likely to occur in the honeycomb structured body.

Moreover, grooves 55, which function as reinforcing portions, are formed on the peripheral side face 54, and the formation of these grooves 55 further increases the strength of the peripheral side face 54, therefore, it may become easier to further prevent the packaging material from being displaced and bent.

In the packaging material 50, grooves 52, which function as reinforcing portions, are formed on the upper face thereof by molding a plastic sheet; while, reinforcing members, made of wood, metal, plastics, cardboard, styrofoam or the like, may be secured to positions on the upper face or the lower face of the plastic sheet corresponding to the positions for these grooves so that the reinforcing portions may be formed.

Moreover, the packaging material in accordance with the embodiment of the first aspect of the present invention may have a shape as shown in FIGS. 8A, 8B, 9A and 9B.

Figure 8A:
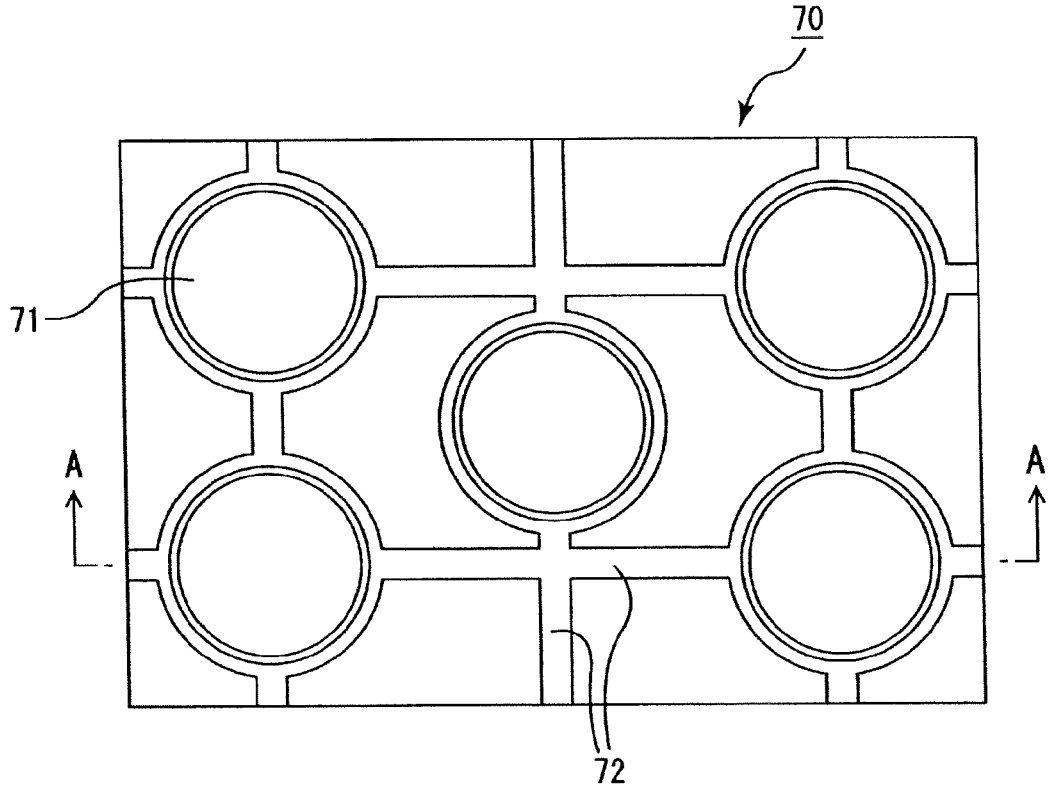
FIG. 8A is a plan view that schematically shows still another example of a packaging material in accordance with one embodiment of the first aspect of the present invention.
Figure 8B:
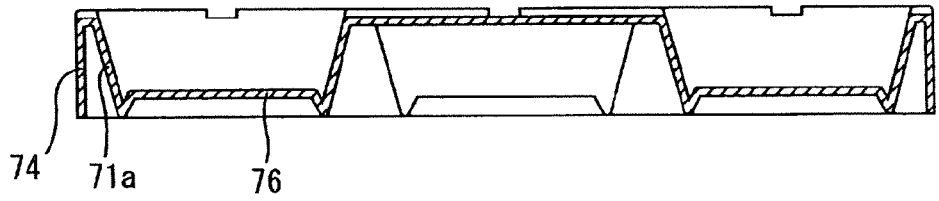
FIG. 8B is a cross-sectional view taken along line A-A of the packaging material of FIG. 8A.
Figure 9A:
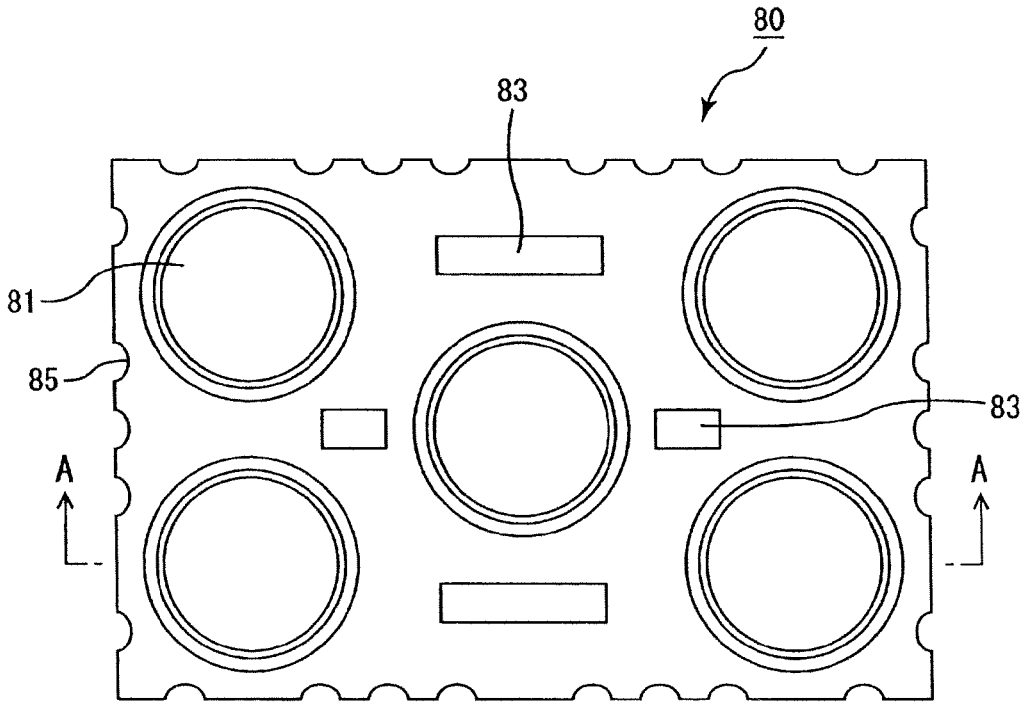
FIG. 9A is a plan view that schematically shows still another example of a packaging material in accordance with one embodiment of the first aspect of the present invention.
Figure 9B:
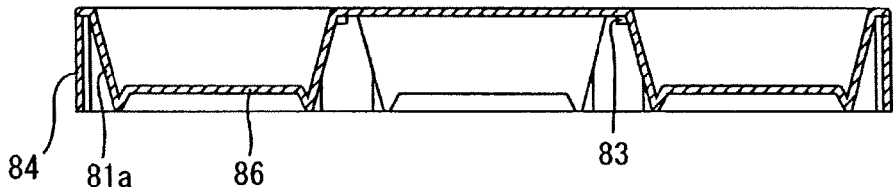
FIG. 9B is a cross-sectional view taken along line A-A of the packaging material of FIG. 9A.

FIGS. 8A and 9A are plan views that schematically show one example of another packaging material in accordance with the embodiment of the first aspect of the present invention, and FIGS. 8B and 9B are cross-sectional views taken along line A-A of the packaging materials shown in FIGS. 8A and 9A, respectively.

The packaging material 70, shown in FIGS. 8A and 8B, is a packaging material formed by molding a plastic sheet, and has a structure in which bottomed holes 71, each used for installing the end face neighborhood of a honeycomb structured body, are formed on its upper face and a plurality of grooves (installation face reinforcing portions) 72 are formed on a part of the area where no bottomed hole 71 is formed. Here, the grooves 72 are formed in such a manner that when each of them crosses another groove, the two grooves are made orthogonal to each other.

A peripheral side face 74, formed by bending a plastic sheet downward, is formed on the peripheral portion of the packaging material 70.

The embodiment of the packaging material 70 shown in FIGS. 8A and 8B is the same as that of the packaging material 50 shown in FIGS. 6A, 6B and 6C, except that no grooves (side face reinforcing portions) are formed on the peripheral side face 74.

The use of the packaging material 70 also tends to prevent displacement and bending of the packaging material at the time when the honeycomb structured body, packaged and housed in the box member, is transported, or the like, and consequently to prevent the honeycomb structured body from being damaged.

In this manner, even in the case where the reinforcing portions are formed only on the upper face of the plastic sheet, the same effects as those of the embodiment of the first aspect of the present invention may be obtained.

The packaging material 80, shown in FIGS. 9A and 9B, is a packaging material formed by molding a plastic sheet, and has a structure in which bottomed holes 81, each used for installing the end face neighborhood of an object to be packaged (honeycomb structured body), are formed on its upper face and a plurality of grooves (installation face reinforcing portions) 83 are formed on a part of an area where no bottomed hole 81 is formed.

A peripheral side face 84, formed by bending a plastic sheet downward, is formed on the peripheral portion of the packaging material 80, and a plurality of grooves (side face reinforcing portions) 85, which serve as reinforcing portions, are further formed on the peripheral side face 84.

The shape of the packaging material 80 shown in FIGS. 9A and 9B is the same as that of the packaging material 50 shown in FIGS. 6A, 6B and 6C, except that in place of the grooves, concave portions 83 are formed on the upper face thereof.

In the same manner as in the grooves 52 formed in the packaging material 50, the concave portions 83 have a function for preventing the packaging material 80 from being bent.

The use of the packaging material 80 also tends to prevent displacement and bending of the packaging material at the time when the honeycomb structured body, packaged and housed in the box member, is transported or the like, and consequently to prevent the honeycomb structured body from being, for example, damaged.

In the packaging material in accordance with the embodiment of the first aspect of the present invention, the grooves and the concave portions serving as the installation face reinforcing portions, which are formed in an area that bears no bottomed holes, are allowed to have virtually the same functions and structures; however in the present specification, those having the end portion extending to the side face of each bottomed hole are referred to as groove, and those formed in a completely independent manner from each bottomed hole is referred to as the concave portion.

With respect to the packaging material in accordance with the embodiment of the first aspect of the present invention, the above description has discussed a structure in which only either one of the groove and the concave portion is formed on each of the installation face for an object to be packaged and the peripheral side face by molding a plastic sheet (plate member); however, in the packaging material in accordance with the embodiment of the first aspect of the present invention, both the groove and the concave portion may be formed on each of the installation face and the peripheral side face of a single packaging material.

Figure 10A:
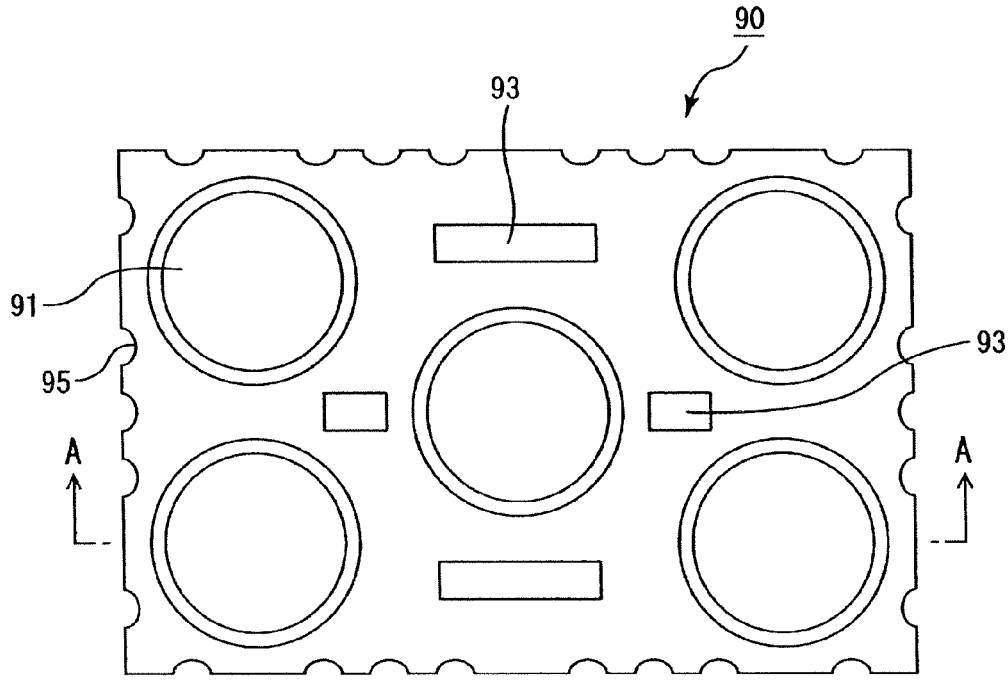
FIG. 10A is a plan view that schematically shows still another example of a packaging material in accordance with one embodiment of the first aspect of the present invention.
Figure 10B:
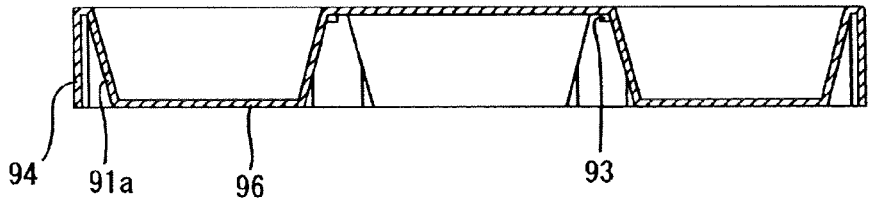
FIG. 10B is a cross-sectional view taken along line A-A of the packaging material of FIG. 10A.

Moreover, the packaging material in accordance with the embodiment of the first aspect of the present invention may be the embodiment as shown in FIGS. 10A and 10B.

FIG. 10A is a plan view that schematically shows another example of the packaging material in accordance with the embodiment of the first aspect of the present invention, and FIG. 10B is a cross-sectional view taken along line A-A of the packaging material of FIG. 10A.

The packaging material 90 shown in FIGS. 10A and 10B is a packaging material formed by molding a plastic sheet, and has a structure in which bottomed holes 91 used for installing the end face neighborhood of an object to be packaged (honeycomb structured body) are formed on its upper face and a plurality of concave portions (installation face reinforcing portions) 93 serving as reinforcing portions are formed on a part of the area where no bottomed holes 91 are formed.

A peripheral side face 94, formed by bending a plastic sheet downward, is formed on the peripheral portion of the packaging material 90, and a plurality of grooves 95 serving as reinforcing portions are formed on the peripheral side face 94.

Each bottomed holes 91 is formed in such a manner that the opening diameter is made greater than the diameter of the end face of a honeycomb structured body, and a side face 91*a* thereof is formed in a tapered shape with the diameter decreasing toward the bottom face.

In this manner, the embodiment of the packaging material 90 shown in FIGS. 10A and 10B is the same as that of the packaging material 80 shown in FIGS. 9A and 9B, except that no raised portion is formed on the bottom face of each bottomed hole 91.

In the packaging material of the present invention, even in the case where no raised portion is formed in each bottomed hole, as long as concave portions are formed on both of the area of the upper face where no bottomed holes are formed and the peripheral side face, the above-mentioned effects, that is, the effects that the occurrence of displacement and bending in the packaging material tends to be prevented at the time when the honeycomb structured body packaged and housed in the box member is transported, and the honeycomb structured body tends to be prevented from being damaged and the like, may be obtained.

Figure 11A:
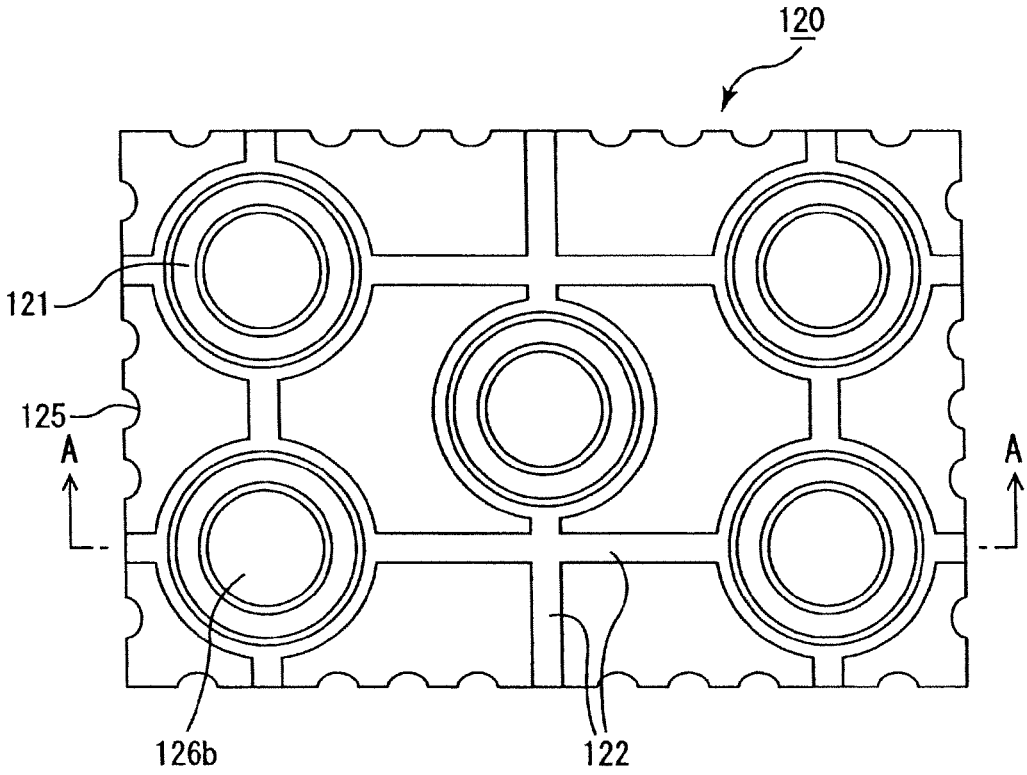
FIG. 11A is a plan view that schematically shows another example of a packaging material in accordance with one embodiment of the first aspect of the present invention.
Figure 11B:
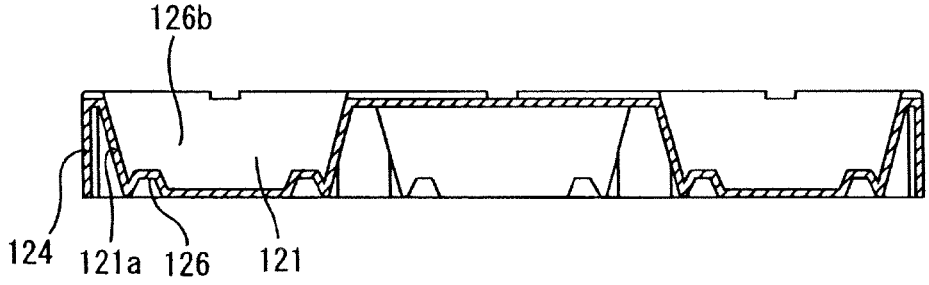
FIG. 11B is a cross-sectional view taken along line A-A of the packaging material shown in FIG. 11A.

The packaging material in accordance with the embodiment of the first aspect of the present invention may be an embodiment as shown in FIGS. 11A and 11B.

FIG. 11A is a plan view that schematically shows another example of the packaging material in accordance with the embodiment of the first aspect of the present invention, and FIG. 11B is a cross-sectional view taken along line A-A of the packaging material of FIG. 11A.

In the same manner as in the packaging material 50 shown in FIGS. 6A, 6B and 6C, a packaging material 120 shown in FIGS. 11A and 11B is provided with bottomed holes 121 that serve as installation portions for honeycomb structured bodies.

Each of the bottomed holes 121 is formed in such a manner that the diameter of its opening portion is made larger than the diameter of the end face of the honeycomb structured body, and the side face 121*a* thereof is formed into a tapered shape with the diameter decreasing toward the bottom face, and a raised bottom portion (installation portion) 126, which holds the end face of the honeycomb structured body, is formed on the bottom face.

The raised bottom portion 126 is formed with such a size that only one portion of the end face of the honeycomb structured body is supported.

Moreover, the raised bottom portion 126 has a shape of a truncated cone shape in which a concave portion 126*b* is formed in the center thereof.

In the case of the installation portion having this structure also, since the contact area between the end face of the honeycomb structured body and the installation portion tends to be made smaller, the occurrence of damage and the like in the honeycomb structured body tends to be reduced.

Here, the shape of the packaging material 120 shown in FIGS. 11A and 11B is the same as that of the packaging material 50 shown in FIGS. 6A, 6B and 6C, except that the shape of the raised bottom portion 126 is different; therefore, the description thereof is omitted.

Figure 12A:
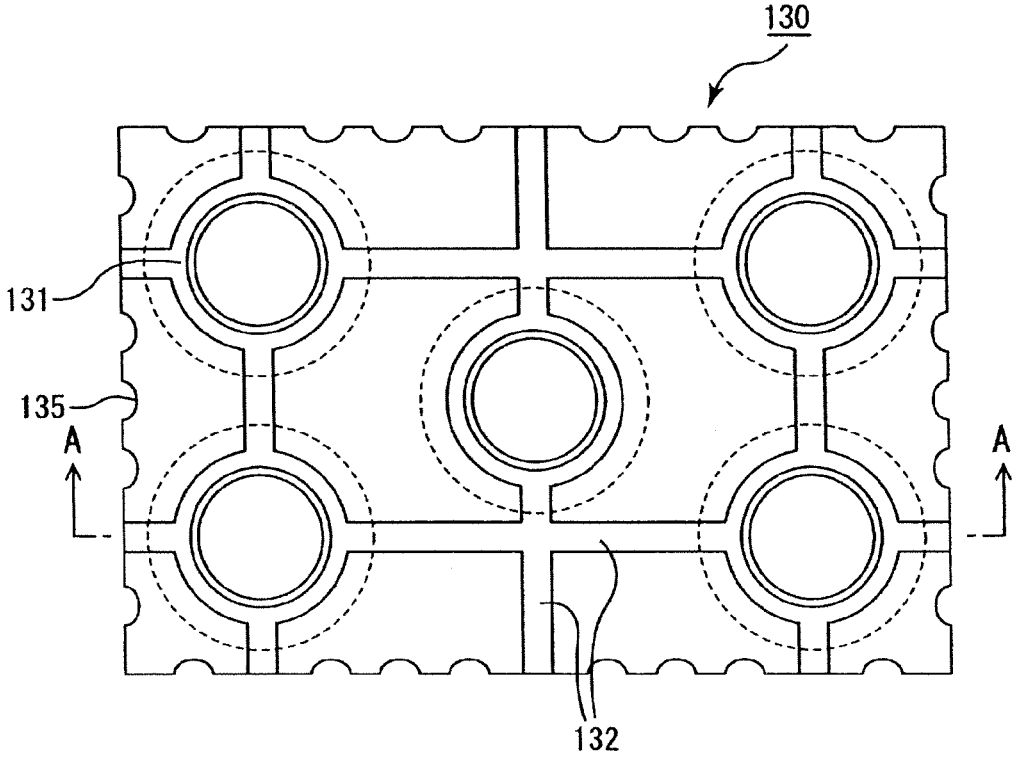
FIG. 12A is a plan view that schematically shows another example of a packaging material in accordance with one embodiment of the first aspect of the present invention.
Figure 12B:
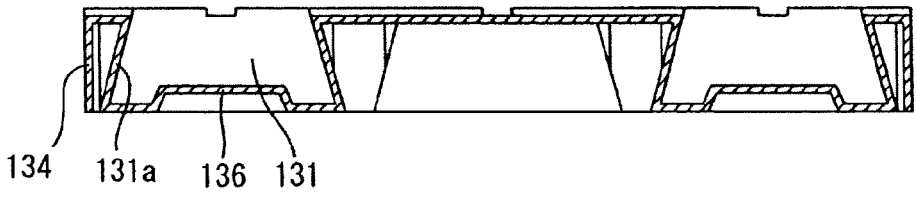
FIG. 12B is a cross-sectional view taken along line A-A of the packaging material shown in FIG. 12A.

The packaging material in accordance with the embodiment of the first aspect of the present invention may be the embodiment as shown in FIGS. 12A and 12B.

FIG. 12A is a plan view that schematically shows another example of the packaging material in accordance with the embodiment of the first aspect of the present invention, and FIG. 12B is a cross-sectional view taken along line A-A of the packaging material of FIG. 12A.

Each of bottomed holes 131 is formed in such a manner that the diameter of its opening portion is made larger than the diameter of the end face of the honeycomb structured body, and a side face 131*a* thereof is formed into a tapered shape with the diameter decreasing toward the bottom face, and a raised bottom portion (installation portion) 136, which holds the end face of the honeycomb structured body, is formed on the bottom face.

The raised bottom portion 136 is formed in a size that supports only a part of the end face of the honeycomb structured body.

In the case also of the installation portion having this structure, since the contact area between the end face of the honeycomb structured body and the installation portion tends to be made smaller, the occurrence of damages and the like to the honeycomb structured body tends to be reduced.

Here, the shape of the packaging material 130 shown in FIGS. 12A and 12B is the same as that of the packaging material 50 shown in FIGS. 6A, 6B and 6C, except that the shape of the bottomed hole 131 is different; therefore, the description thereof is omitted.

In the packaging material in accordance with the embodiment of the first aspect of the present invention, the bottomed hole used for housing the end face neighborhood of the honeycomb structured body is not necessarily formed into a tapered shape on its side face as shown in FIG. 6C and the like, and the opening and the bottom face may have the same diameter.

Moreover, the packaging material is made of a plate member, and a plastic sheet may be used as the plate member.

Specific examples of the plastic material include polypropylene, polyethylene, polyethylene terephthalate and the like.

The material for the plate member is not limited to plastics, and the examples thereof include cardboard, styrofoam, and the like.

The following description will discuss a method for manufacturing the packaging material in accordance with the embodiment of the first aspect of the present invention.

In the case where the packaging material is constituted by a plastic sheet in its entire portion including reinforcing portions, it can be manufactured by using a conventionally known molding method for a plastic material, such as a vacuum molding method and an injection molding method, and while in the case where the reinforcing portions are formed by using another material such as metal and wood, a method in which the base portion (portions other than the reinforcing portions) of the packaging material is manufactured by the above-mentioned method, and the reinforcing portions are secured thereto by using a bonding agent or the like, may be used.

Next, the following description will discuss the packaging material in accordance with the embodiment of the second aspect of the present invention.

With respect to the specific shape of the packaging material in accordance with the embodiment of the second aspect of the present invention, example thereof include a shape in which no reinforcing portions are formed, and an installation portion that is the same as in the packaging materials shown in FIGS. 6A, 6B, 8A to 12B is formed, and the like.

With this shape, the end face neighborhood of the object to be packaged can be easily inserted into the bottomed hole so that the object to be packaged can be easily packaged.

The packaging material in accordance with the embodiment of the second aspect of the present invention is made of a plate member, and specific examples of the plate member include those plate members similar to the plate members constituting the packaging materials in accordance with the embodiment of the first aspect of the present invention.

Moreover, the packaging material in accordance with the embodiment of the second aspect of the present invention can be manufactured by using a conventionally known molding method for a plastic material, such as a vacuum molding method and an injection molding method, and the like.

Next, the following description will discuss the packaging material in accordance with the embodiment of the third aspect of the present invention.

With respect to the specific shape of the packaging material in accordance with the embodiment of the third aspect of the present invention, example thereof include a shape in which no reinforcing portions are formed, and an installation portion that is the same as those packaging materials shown in FIGS. 6A, 6B, 8A to 9B, 11A to 12B is formed, and the like.

With this shape, the end face (particularly, corner portions of the end face) tends not to come into contact with the object to be packaged, and thus damage is far less likely to happen.

The packaging material in accordance with the embodiment of the third aspect of the present invention is made of a plate member, and specific examples of the plate member include those plate members similar to the plate member constituting the packaging materials in accordance with the embodiment of the first aspect of the present invention.

Moreover, the packaging material in accordance with the embodiment of the third aspect of the present invention can be manufactured by using a conventionally known molding method for a plastic material, such as a vacuum molding method and an injection molding method, and the like.

Next, the following description will discuss the packaging material in accordance with the embodiment of the fourth aspect of the present invention.

Figure 13A:
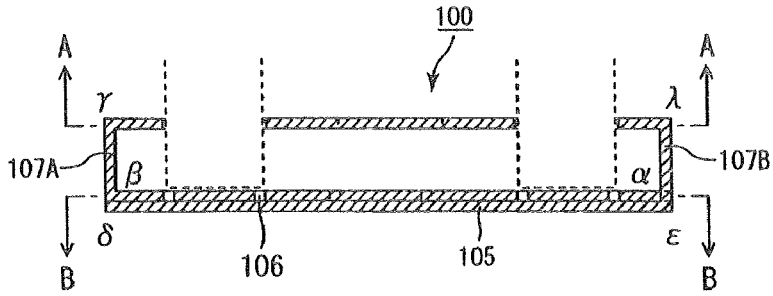
FIG. 13A is a vertical cross-sectional view that shows a packaging material in accordance with one embodiment of the fourth aspect of the present invention.
Figure 13B:
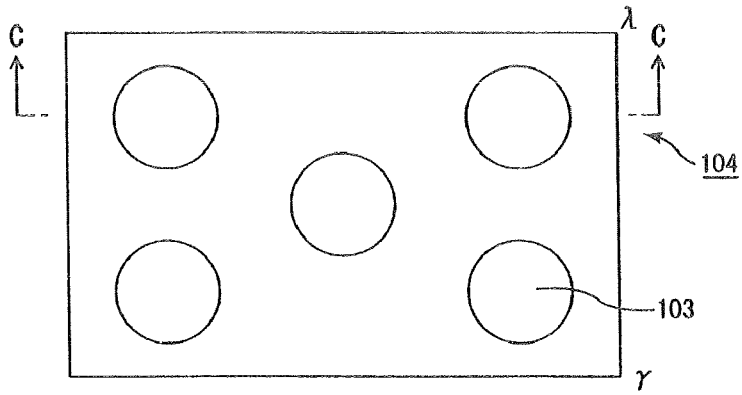
FIG. 13B is a cross-sectional view of FIG. 13A taken along line A-A.
Figure 13C:
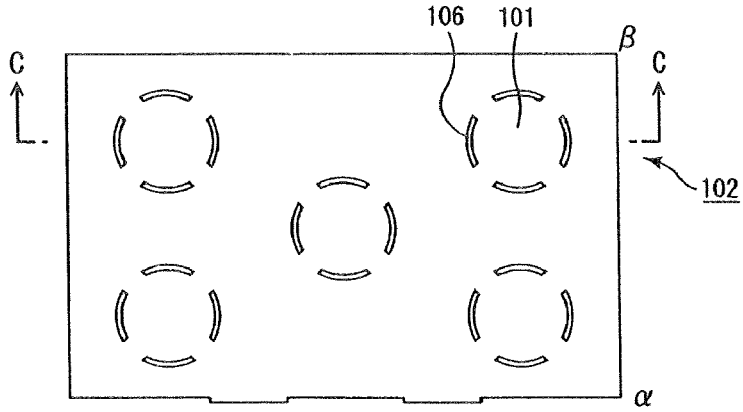
FIG. 13C is a cross-sectional view of FIG. 13A taken along line B-B.
Figure 13D:
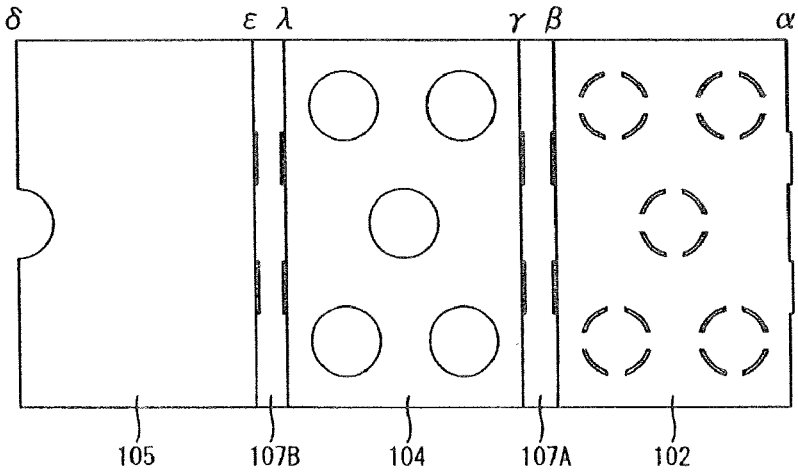
FIG. 13D is a developed view of the packaging material shown in FIG. 13A.

FIG. 13A is a vertical cross-sectional view that shows a packaging material in accordance with the embodiment of the fourth aspect of the present invention, FIG. 13B is a cross-sectional view taken along line A-A of FIG. 13A, FIG. 13C is a cross-sectional view taken along line B-B of FIG. 13A, and FIG. 13D is a developed view of the packaging material shown in FIG. 13A.

Here, FIG. 13A is a vertical cross-sectional view taken along line C-C of each of FIGS. 13B and 13C.

Moreover, $\alpha$ to $\lambda$ in FIG. 13A respectively correspond to $\alpha$ to $\lambda$ in those of each FIGS. 13B to 13D.

A packaging material 100 is a packaging material formed by processing a sheet of cardboard, and comprises: an installation member 102 in which an installation portion 101 for placing the end face neighborhood of the end faces of an object to be packaged (honeycomb structured body) is formed, a holding member 104 in which a through hole 103 is formed, and a protective member 105, and the above members are configured into an integral unit through connecting portions 107A and 107B.

A notched portion 106 is formed on the periphery of the installation unit 101 so that the entire bottom face of the object to be packaged is prevented from coming into contact with the protective member and the installation member.

Here, the notched portion 106 may be formed on demand.

Upon manufacturing the packaging material 100 of this kind, a cardboard having a large area as shown in FIG. 13D is used, and first, two side portions are bent downward along lines extending from starting points $\gamma$ and $\lambda$, and further bent inward along lines extending from starting points $\beta$ and $\epsilon$ so that the installation member 102 and the protective member 105 are superposed one on the other. Lastly, the two side portions respectively sandwiching the lines extending from the starting points $\gamma$ and $\lambda$, as well as the lines extending from the starting points $\beta$ and $\epsilon$, are folded inward so as to make a 90° angle each so that the installation member 102 and the protective member 105 are completely overlapped with each other. Here, upon the superposition, the installation member 102 is arranged to be placed on the protective member 105. By folding in the above manner, it may become possible for a packaging material 100, which has a rectangular parallelepiped shape in the outer appearance and has a cross section shown in FIG. 13A, taken along line C-C of each of FIGS. 13B and 13C, to be manufactured.

In this packaging material 100, the end portion of a honeycomb structured body (indicated by a dotted line in the FIG. 13D) is placed on the installation portion 101 of the installation member 102, with the honeycomb structured body being allowed to penetrate the through hole 103 formed in the holding member 104; accordingly, it may become possible for the honeycomb structured body to be held.

Here, since the protective member 105 is formed, the strength of the packaging material tends to be improved. Therefore, no displacement or the like are caused in the honeycomb structured body, and thus the object to be packaged tends to be surely held.

Moreover, since the installation member 102, the holding member 104 and the protective member 105 are configured into an integral unit, the packaging material 100 has such a superior strength that it tends to prevent a packaging material from being bent at the time of transporting the packaging material housed in a box member, and consequently, damage and the like to the honeycomb structured body tends to be prevented.

In the packaging material 100, peripheral side faces 107A and 107B are formed between the installation member 102 and the holding member 104, and between the holding member 104 and the protective member 105, respectively.

In this manner, the formation of the peripheral side faces 107A and 107B tends to make it easier to increase the contact area between the packaging material 100 and the inner face of a box member when the packaging material 100 is housed in the box member, and consequently the risk of displacement or bending of the packaging material 100 inside the box member is reduced, so that it may become easier to further prevent the honeycomb structured body from being damaged.

Here, concave portions and through holes may be formed on the peripheral side faces 107A and 107B, if necessary. These arrangements contribute to weight saving and an easy bending upon manufacturing. In particular, in the case where a convex portion is formed on the installation member 102, a concave portion is preferably formed on the side face 107B to achieve an easy fitting.

The material for the packaging material in accordance with the embodiment of the fourth aspect of the present invention is not limited to cardboard, and plastic materials, styrofoam, and the like may be used in the same manner as in the packaging material in accordance with the embodiment of the first aspect of the present invention.

The packaging material in accordance with the embodiment of the fourth aspect of the present invention may be manufactured by processing, for example, a cardboard through a conventionally known method.

Next, the following description will discuss the packaging material in accordance with the embodiment of the fifth aspect of the present invention.

Figure 14A:
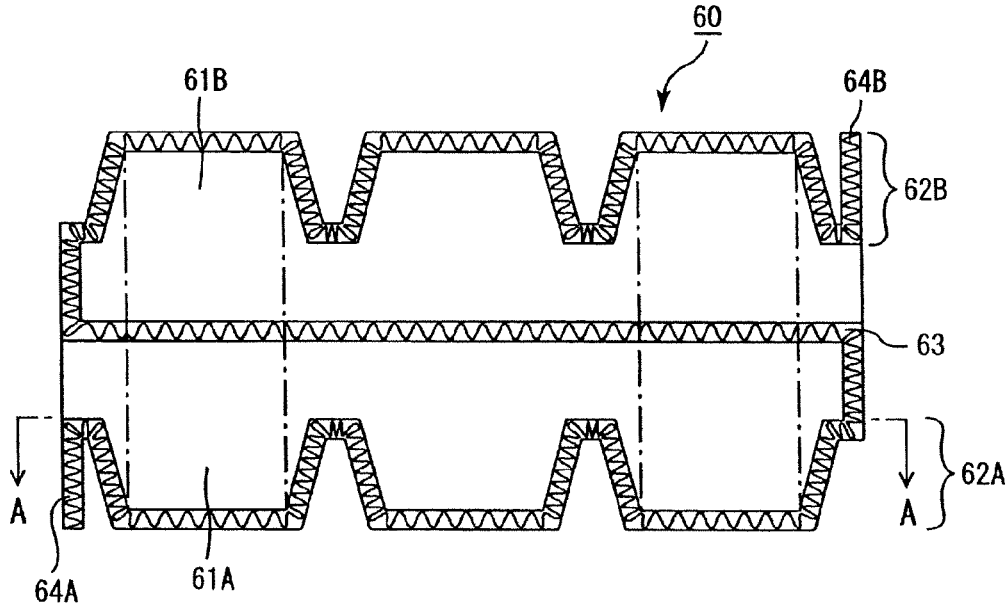
FIG. 14A is a vertical cross-sectional view that shows a packaging material in accordance with one embodiment of the fifth aspect of the present invention.
Figure 14B:
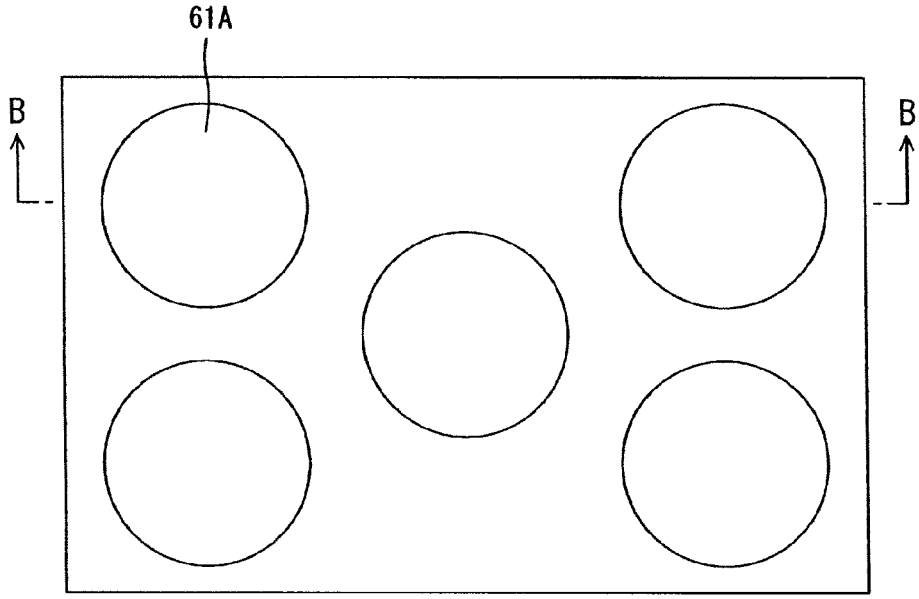
FIG. 14B is a horizontal cross-sectional view of the packaging material in accordance with one embodiment of the fifth aspect of the present invention.

FIG. 14A is a vertical cross-sectional view that shows a packaging material in accordance with the embodiment of the fifth aspect of the present invention, and FIG. 14B is a horizontal cross-sectional view of the packaging material in accordance with the fifth aspect of the present invention.

Here, FIG. 14A is a vertical cross-sectional view taken along line B-B of FIG. 14B, and FIG. 14B is a horizontal cross-sectional view taken along line A-A of FIG. 14A.

A packaging material 60 is a packaging material formed by processing a sheet of cardboard, and has a structure in which: a bottom holding member 62A in which a bottomed hole 61A that houses an end face neighborhood of one of the end faces of the object to be packaged (honeycomb structured body) is formed, and an upper holding member 62B in which a bottomed hole 61B that houses the end face neighborhood of the other end face of the honeycomb structured body is formed are configured into an integral unit through an intermediate holding member 63.

The bottomed hole 61A and the bottomed hole 61B are formed at such positions as to be overlapped with each other in the plan view.

Moreover, the through hole that allows the penetration of the honeycomb structured body is formed in the intermediate holding member 63 and the through hole is formed in such a position that the bottomed hole 61A and the bottomed hole 61B are overlapped with each other in the plan view.

In the packaging material 60 of this kind, the end portions of a honeycomb structured body (indicated by a dashed line in FIG. 14A) are respectively held by the bottomed hole 61A and the bottomed hole 61B, and by allowing the honeycomb structured body to penetrate the through hole formed in the intermediate holding member 63, the honeycomb structured body is further supported.

With this structure, a displacement and the like tends to be prevented, so that the honeycomb structured body tends to be surely supported without displacement and the like.

Moreover, the packaging material 60 has a structure in which the bottom holding member 62A, the upper holding member 62B and the intermediate holding member 63 are configured into an integral unit, therefore has such a superior strength that it tends to prevent a packaging material from being bent at the time of transporting the packaging material housed in a box member, and consequently, damage and the like to the honeycomb structured body tends to be prevented.

In the packaging material 60, peripheral side faces 64A and 64B are respectively formed on the bottom holding member at the side opposite to the side that is integral with the intermediate holding member, and on the upper holding member at the side opposite to the side that is integral with the intermediate holding member.

By forming the peripheral side faces 64A and 64B, the contact area between the packaging material 60 and the inner face of a box member tends to be increased when the packaging material 60 is housed in the box member, and consequently the risk of displacement or bending of the packaging material 60 inside the box member is reduced, therefore, it may become easier to further prevent the honeycomb structured body from being damaged.

Moreover, concave portions may be formed on the peripheral side faces 64A and 64B, if necessary.

The material for the packaging material in accordance with the embodiment of the fifth aspect of the present invention is not limited to cardboard, and plastic materials, styrofoam, and the like may be used in the same manner as in the packaging material in accordance with the embodiment of the first aspect of the present invention.

The packaging material in accordance with the embodiment of the fifth aspect of the present invention may be manufactured by processing, for example, a cardboard through a conventionally known method.

In accordance with the packaging materials of the embodiments of the first to fifth aspects of the present invention, the packaging material tends not to bend even upon receipt of an externally applied impact or the like. Consequently, damage such as cracks tends not to occur in an object to be packaged that has been packaged by this packaging material. Thus, it may become easier to reduce the rate of occurrence of the damage at the time of transporting the packaged object.

Methods of transporting a honeycomb structured body in accordance with the embodiments of the sixth to tenth aspects of the present invention are methods of transporting a honeycomb structured body by using the packaging materials of the first to fifth aspects of the present invention, respectively, and since the transporting method has been explained above in the present specification, the specific explanation thereof is omitted.

In accordance with methods of transporting a honeycomb structured body of the embodiments of the sixth to tenth aspects of the present invention, even when a box member in which a honeycomb structured body packaged with the packaging material has been housed receives an impact or the like from the outside, the packaging material tends not to bend. Consequently, damage such as cracks tends not to occur in the honeycomb structured body that has been packaged with this packaging material. Thus, it may become easier to reduce the rate of occurrence of the damage at the time of transporting the honeycomb structured body.

With respect to the honeycomb structured body, examples thereof include a filter used for capturing particulates in the exhaust gas, a honeycomb structured body used as a catalyst supporting carrier for converting the exhaust gas, and the like.

EXAMPLES

The following description will discuss the present invention in detail by means of examples; however, the present invention is not intended to be limited only by these examples.

Example 1

A packaging material having the same shape as in the packaging material 10 of FIGS. 1A, 1B and 1C was manufactured.

In this case, a polypropylene sheet of 0.5 mm in thickness was used as a plate member, and each of reinforcing portions (installation face reinforcing portions) 12 was formed by securing a plywood plate of 20 mm in width and 1 mm in thickness. Here, each of the installation portions 11 had a size of 130 mm in the upper face diameter×150 mm in the bottom face diameter, the groove (side face reinforcing portion) 15 in the peripheral side face portion 14 had a size of 20 mm in width×5 mm in depth, and the external size was set to 560 mm in width×380 mm in length×50 mm in height.

Moreover, the polypropylene sheet was processed so that the surface roughness of the upper face of the installation portion 11 was set to 0.1 mm.

Examples 2 and 3

A packaging material was manufactured in the same manner as in Example 1, except that grooves 15 were not formed in the peripheral side face portion 14, and a plywood plate (Example 2) of 20 mm in width and 1 mm in thickness, or an aluminum plate (Example 3) of 20 mm in width and 0.5 mm in thickness was secured onto a position corresponding to each of the grooves as a side face reinforcing portion.

Example 4

A packaging material was manufactured in the same manner as in Example 1, except that, in place of each of the grooves on the peripheral side face, a concave portion (see 45 in FIG. 5A) having a size of 20 mm in width×5 mm in depth×30 mm in height was formed as a side face reinforcing portion.

Examples 5 to 8

A packaging material was manufactured in the same manner as in the respective Examples 1 to 4, except that the reinforcing portion 12 was formed by using an aluminum plate of 2 mm in width and 0.5 mm in thickness in place of the plywood plate.

Examples 9 to 12

A packaging material was manufactured in the same manner as in the respective Examples 1 to 4, except that the reinforcing portion 12 was formed not by securing a plywood plate, but by molding the polypropylene sheet.

Here, the reinforcing portion had a size of 20 mm in width×5 mm in height.

Examples 13 to 16

A packaging material was manufactured in the same manner as in the respective Examples 9 to 12, except that the shape of each installation face reinforcing portion was changed to a reinforcing portion 43 shown in FIGS. 5A and 5B from a reinforcing portion 12 shown in FIGS. 1A, 1B and 1C.

Here, the reinforcing portion had a size of 20 mm in width×150 mm in length×5 mm in height or 20 mm in width×50 mm in length×5 mm in height.

Test Examples 1 to 4

A packaging material was manufactured in the same manner as in the respective Examples 1, 5, 9 and 13, except that no side face reinforcing portions were formed.

Test Examples 5 to 8

A packaging material was manufactured in the same manner as in the respective Examples 1 to 4, except that no installation face reinforcing portions were formed.

Example 17

A packaging material having the same shape as in the packaging material 110 of FIGS. 3A and 3B was manufactured.

In this case, a polypropylene sheet of 0.5 mm in thickness was used as a plate member, and each of reinforcing portions (installation face reinforcing units) 112 was formed by securing a plywood plate of 20 mm in width and 1 mm in thickness. Here, each of the installation portions 111 had a size of 130 mm in the upper face outer diameter $L_1$, 120 mm in the upper face inner diameter $L_2$, 150 mm in the bottom face outer diameter $M_1$ and 100 mm in the bottom face inner diameter $M_2$, and each of grooves (side face reinforcing portions) 115 of the peripheral side face 114 had a size of 20 mm in width×5 mm in depth, and the external size was set to 560 mm in width×380 mm in depth×50 mm in height.

Moreover, the polypropylene sheet was processed so that the surface roughness of the upper face of the installation portion 111 was set to 1 mm.

Examples 18 and 19

A packaging material was manufactured in the same manner as in Example 17, except that grooves 115 were not formed on the peripheral side face 114, and a plywood plate (Example 18) of 20 mm in width and 1 mm in thickness, or an aluminum plate (Example 19) of 20 mm in width and 0.5 mm in thickness was secured as a side face reinforcing portion onto a position corresponding to each of the grooves.

Example 20

A packaging material was manufactured in the same manner as in Example 17, except that, in place of each of the grooves on the peripheral side face, a concave portion (see 45 in FIG. 5A) having a size of 20 mm in width×5 mm in depth×30 mm in height was formed as a side face reinforcing portion.

Examples 21 to 24

A packaging material was manufactured in the same manner as in the respective Examples 17 to 20, except that the reinforcing portion 112 was formed by using an aluminum plate of 2 mm in width and 0.5 mm in thickness in place of the plywood plate.

Examples 25 to 28

A packaging material was manufactured in the same manner as in the respective Examples 17 to 20, except that the reinforcing portion 112 was formed not by securing a plywood plate, but by molding the polypropylene sheet.

Here, the reinforcing portion had a size of 20 mm in width×5 mm in height.

Examples 29 to 32

A packaging material was manufactured in the same manner as in the respective Examples 17 to 20, except that the shape of each reinforcing portion to be formed on the same face as the face bearing the installation portion was changed to that of a reinforcing portion 43 shown in FIGS. 5A and 5B from that of a reinforcing portion 112 shown in FIGS. 3A and 3B.

Here, the reinforcing portion had a size of 20 mm in width×150 mm in length×5 mm in height or 20 mm in width×50 mm in length×5 mm in height.

Test Examples 9 to 12

A packaging material was manufactured in the same manner as in the respective Examples 17, 21, 25 and 29, except that no side face reinforcing portions were formed.

Test Examples 13 to 16

A packaging material was manufactured in the same manner as in the respective Examples 17 to 20, except that no installation face reinforcing portions were formed.

Examples 33

A packaging material having the same shape as in the packaging material 50 shown in FIGS. 6A, 6B and 6C was manufactured.

In this case, a polypropylene sheet of 0.5 mm in thickness was used as a plate member, and each of reinforcing portions (grooves) 52 had a size of 20 mm in width and 5 mm in depth. Moreover, the bottomed hole 51 had a size of 155 mm in the opening diameter, 150 mm in the bottom face diameter and 130 mm in the upper face diameter of the raised bottom portion 56, and each groove (side face reinforcing portion) 55 of the peripheral side face 54 had a size of 20 mm in width×5 mm in depth and an external size of 560 mm in width×380 mm in depth×50 mm in height.

Moreover, the polypropylene sheet was processed so that the surface roughness of the upper face of the raised bottom portion 56 was set to 0.1 mm.

Examples 34 and 35

A packaging material was manufactured in the same manner as in Example 33, except that grooves 55 were not formed on the peripheral side face 54, and a plywood plate (Example 34) of 20 mm in width and 1 mm in thickness or an aluminum plate (Example 35) of 20 mm in width and 0.5 mm in thickness was secured onto a position corresponding to each of the grooves as a side face reinforcing portion.

Example 36

A packaging material was manufactured in the same manner as in Example 33, except that, in place of each of the grooves on the peripheral side face, a concave portion (see 45 in FIG. 5A) having a size of 20 mm in width×5 mm in depth×30 mm in height was formed as a side face reinforcing portion.

Examples 37 to 40

A packaging material was manufactured in the same manner as in the respective Examples 33 to 36, except that grooves 52 were not formed, and a plywood plate of 2 mm in width and 1 mm in thickness was secured as an installation face reinforcing portion onto a position corresponding to each of the grooves.

Examples 41 to 44

A packaging material was manufactured in the same manner as in the respective Examples 33 to 36, except that grooves 52 were not formed, and an aluminum plate of 2 mm in width and 0.5 mm in thickness was secured onto a position corresponding to each of the grooves as an installation face reinforcing portion.

Examples 45 to 48

A packaging material was manufactured in the same manner as in the respective Examples 33 to 36, except that the shape of each installation face reinforcing portion was changed to that of a concave portion 83 shown in FIGS. 9A and 9B from that of the groove 52 shown in FIGS. 6A and 6B.

Here, the reinforcing portion had a size of 20 mm in width× 150 mm in length×5 mm in depth or 20 mm in width×50 mm in length×5 mm in depth.

Test Examples 17 to 20

A packaging material was manufactured in the same manner as in the respective Examples 33, 37, 41 and 45, except that no side face reinforcing portions were formed.

Test Examples 21 to 24

A packaging material was manufactured in the same manner as in the respective Examples 33 to 36, except that no installation face reinforcing portions were formed.

Example 49

A packaging material having the same shape as in the packaging material 120 of FIGS. 11A and 11B was manufactured.

In this case, a polypropylene sheet of 0.5 mm in thickness was used as a plate member, and each of the grooves (installation face reinforcing units) 122 had a size of 20 mm in width and 5 mm in depth. Moreover, the bottomed hole 121 had a size of 155 mm in the opening diameter and 150 mm in the bottom face diameter, and the raised bottom portion 126 had a size of 130 mm in outer diameter and 120 mm in inner diameter, and each groove (side face reinforcing portion) 125 of the peripheral side face 124 had a size of 20 mm in width×5 mm in depth and an external size of 560 mm in width×380 mm in depth×50 mm in height.

Moreover, the polypropylene sheet was processed so that the surface roughness of the upper face of the raised bottom portion 126 was set to 1 mm.

Examples 50 and 51

A packaging material was manufactured in the same manner as in Example 49, except that grooves 125 were not formed on the peripheral side face 124, and a plywood plate (Example 50) of 20 mm in width and 1 mm in thickness or an aluminum plate (Example 51) of 20 mm in width and 0.5 mm in thickness was secured onto a position corresponding to each of the grooves as a side face reinforcing portion.

Example 52

A packaging material was manufactured in the same manner as in Example 49, except that, in place of each of the grooves on the peripheral side face, a concave portion (see 45 in FIG. 5A) having a size of 20 mm in width×5 mm in depth×30 mm in height was formed as a side face reinforcing portion.

Examples 53 to 56

A packaging material was manufactured in the same manner as in the respective Examples 49 to 52, except that the grooves 122 were not formed, and a plywood plate of 2 mm in width and 1 mm in thickness was secured onto a position corresponding to each of the grooves as an installation face reinforcing portion.

Examples 57 to 60

A packaging material was manufactured in the same manner as in the respective Examples 49 to 52, except that the grooves 122 were not formed, and an aluminum plate of 2 mm in width and 0.5 mm in thickness was secured onto a position corresponding to each of the grooves as an installation face reinforcing portion.

Examples 61 to 64

A packaging material was manufactured in the same manner as in the respective Examples 49 to 52, except that the shape of each installation face reinforcing portion was changed to that of a concave portion 83 shown in FIGS. 9A and 9B from that of the groove 122 shown in FIG. 11A.

Here, the reinforcing portion had a size of 20 mm in width× 150 mm in length×5 mm in height, or 20 mm in width×50 mm in length×5 mm in depth.

Test Examples 25 to 28

A packaging material was manufactured in the same manner as in the respective Examples 49, 53, 57 and 61, except that no side face reinforcing portions were formed.

Test Examples 29 to 32

A packaging material was manufactured in the same manner as in the respective Examples 49 to 52, except that no installation face reinforcing portions were formed.

Example 65

A packaging material having the same shape as in the packaging material 130 of FIGS. 12A and 12B was manufactured.

In this case, a polypropylene sheet of 0.5 mm in thickness was used as a plate member, and each of grooves (installation face reinforcing portions) 132 had a size of 20 mm in width and 5 mm in depth. Moreover, the bottomed hole 131 had a size of 155 mm in the opening diameter and 165 mm in the bottom face diameter, and the raised bottom portion 136 had a size of 130 mm in outer diameter, and each groove (side face reinforcing portion) 135 of the peripheral side face 134 had a size of 20 mm in width×5 mm in depth and an external size of 560 mm in width×380 mm in depth×50 mm in height.

Moreover, the polypropylene sheet was processed so that the surface roughness of the upper face of the raised bottom portion 136 was set to 1 mm.

Examples 66 and 67

A packaging material was manufactured in the same manner as in Example 65, except that grooves 135 were not formed on the peripheral side face 134, and a plywood plate (Example 66) of 20 mm in width and 1 mm in thickness or an aluminum plate (Example 67) of 20 mm in width and 0.5 mm in thickness was secured onto a position corresponding to each of the grooves as a side face reinforcing portion.

Example 68

A packaging material was manufactured in the same manner as in Example 65, except that, in place of each of the grooves on the peripheral side face, a concave portion (see 45 in FIG. 5A) having a size of 20 mm in width×5 mm in depth×30 mm in height was formed as a side face reinforcing portion.

Examples 69 to 72

A packaging material was manufactured in the same manner as in the respective Examples 65 to 68, except that grooves 132 were not formed, and a plywood plate of 2 mm in width and 1 mm in thickness was secured onto a position corresponding to each of the grooves as an installation face reinforcing portion.

Examples 73 to 76

A packaging material was manufactured in the same manner as in the respective Examples 65 to 68, except that grooves 132 were not formed, and an aluminum plate of 2 mm in width and 0.5 mm in thickness was secured onto a position corresponding to each of the grooves as an installation face reinforcing portion.

Examples 77 to 80

A packaging material was manufactured in the same manner as in the respective Examples 65 to 68, except that the shape of each installation face reinforcing portion was changed to that of a concave portion 83 shown in FIGS. 9A and 9B from that of the groove 132 shown in FIG. 12A.

Here, the reinforcing portion had a size of 20 mm in width×150 mm in length×5 mm in depth, or 20 mm in width×50 mm in length×5 mm in depth.

Test Examples 33 to 36

A packaging material was manufactured in the same manner as in the respective Examples 65, 69, 73 and 77, except that no side face reinforcing portions were formed.

Test Examples 37 to 40

A packaging material was manufactured in the same manner as in the respective Examples 65 to 68, except that no installation face reinforcing portions were formed.

Example 81

A packaging material 60 having a shape shown in FIGS. 14A and 14B was manufactured by processing a cardboard having a thickness of 5 mm.

The packaging material 60 manufactured in the present example had an external size of 530 mm×340 mm, and each of bottomed holes 61A and 61B had an opening diameter of 148 mm.

Example 82

A packaging material 100 having a shape shown in FIGS. 13A, 13B and 13C was manufactured by processing a cardboard having a thickness of 5 mm.

The packaging material 100 manufactured in the present example had an external size of 530 mm×340 mm×50 mm, and each of through holes 103 had an opening diameter of 148 mm.

Comparative Example 1

A packaging material having the same shape as in the packaging material 10 of FIGS. 1A, 1B and 1C, except that the reinforcing portions 12 and grooves 15 were not formed, was manufactured by processing a cardboard having a thickness of 5 mm.

(Evaluation)

(1) Preparation of Honeycomb Structured Body

A honeycomb structured body having a diameter of 145 mm and a length of 150 mm, made from silicon carbide, was manufactured by using a conventionally known method.

(2) Five honeycomb structured bodies, manufactured in the above-mentioned process (1), were packaged, with the two end faces being held, by using each of the packaging materials according to Examples, Test Examples and Comparative Examples, and the packaged honeycomb structured bodies were then housed in a box member made of cardboard.

Here, in Examples, Test Examples and Comparative Examples, the honeycomb structured bodies were packaged basically by sandwiching them using two packaging materials; however, only in the case of the packaging material according to Example 81, the honeycomb structured bodies were packaged by using a single packaging material.

(3) Next, each of the box members housing the honeycomb structured bodies was maintained horizontally at a height of 1 m from the ground, and then dropped onto the ground.

(4) After having been dropped, the honeycomb structured bodies were observed as to whether or not any positional displacement occurred and as to whether or not any damages such as cracks occurred in the honeycomb structured bodies. The dropping tests were repeatedly conducted 5 times as well as 50 times.

Tables 1 to 6 show the results of the tests.

TABLE 1

| | Installation portion | | | | | | | Evaluation (repetitive dropping) | | | |
|---|---|---|---|---|---|---|---|---|---|---|---|
| | | | | | | | | 5 times | | 50 times | |
| | | | Surface roughness | Installation face reinforcing portion | | Side face reinforcing portion | | Dis-place- | | Dis-place- | |
| | Plate member | Shape | (mm) | Material | Shape | Material | Shape | ment | Damage | ment | Damage |
| Example 1 | Polypro-pylene | FIGS. 1A to 1C | 0.1 | Plywood | FIGS. 1A to 1C | Polypro-pylene | FIG. 1B | No | No | No | No |
| Example 2 | Polypro-pylene | FIGS. 1A to 1C | 0.1 | Plywood | FIGS. 1A to 1C | Plywood | Secured plate member | No | No | No | No |

TABLE 1-continued

| | | Installation portion | | | | | | Evaluation (repetitive dropping) | | | |
|---|---|---|---|---|---|---|---|---|---|---|---|
| | | | | | | | | 5 times | | 50 times | |
| | Plate member | Shape | Surface roughness (mm) | Installation face reinforcing portion Material | Installation face reinforcing portion Shape | Side face reinforcing portion Material | Side face reinforcing portion Shape | Displacement | Damage | Displacement | Damage |
| Example 3 | Polypropylene | FIGS. 1A to 1C | 0.1 | Plywood | FIGS. 1A to 1C | Aluminum | Secured plate member | No | No | No | No |
| Example 4 | Polypropylene | FIGS. 1A to 1C | 0.1 | Plywood | FIGS. 1A to 1C | Polypropylene | FIG. 5A | No | No | No | No |
| Example 5 | Polypropylene | FIGS. 1A to 1C | 0.1 | Aluminum | FIGS. 1A to 1C | Polypropylene | FIG. 1B | No | No | No | No |
| Example 6 | Polypropylene | FIGS. 1A to 1C | 0.1 | Aluminum | FIGS. 1A to 1C | Plywood | Secured plate member | No | No | No | No |
| Example 7 | Polypropylene | FIGS. 1A to 1C | 0.1 | Aluminum | FIGS. 1A to 1C | Aluminum | Secured plate member | No | No | No | No |
| Example 8 | Polypropylene | FIGS. 1A to 1C | 0.1 | Aluminum | FIGS. 1A to 1C | Polypropylene | FIG. 5A | No | No | No | No |
| Example 9 | Polypropylene | FIGS. 1A to 1C | 0.1 | Polypropylene | FIGS. 1A to 1C | Polypropylene | FIG. 1B | No | No | No | No |
| Example 10 | Polypropylene | FIGS. 1A to 1C | 0.1 | Polypropylene | FIGS. 1A to 1C | Plywood | Secured plate member | No | No | No | No |
| Example 11 | Polypropylene | FIGS. 1A to 1C | 0.1 | Polypropylene | FIGS. 1A to 1C | Aluminum | Secured plate member | No | No | No | No |
| Example 12 | Polypropylene | FIGS. 1A to 1C | 0.1 | Polypropylene | FIGS. 1A to 1C | Polypropylene | FIG. 5A | No | No | No | No |
| Example 13 | Polypropylene | FIGS. 1A to 1C | 0.1 | Polypropylene | FIGS. 5A, 5B | Polypropylene | FIG. 1B | No | No | No | No |
| Example 14 | Polypropylene | FIGS. 1A to 1C | 0.1 | Polypropylene | FIGS. 5A, 5B | Plywood | Secured plate member | No | No | No | No |
| Example 15 | Polypropylene | FIGS. 1A to 1C | 0.1 | Polypropylene | FIGS. 5A, 5B | Aluminum | Secured plate member | No | No | No | No |
| Example 16 | Polypropylene | FIGS. 1A to 1C | 0.1 | Polypropylene | FIGS. 5A, 5B | Polypropylene | FIG. 5A | No | No | No | No |
| Test Example 1 | Polypropylene | FIGS. 1A to 1C | 0.1 | Plywood | FIGS. 1A to 1C | None | — | No | No | Yes | Yes |
| Test Example 2 | Polypropylene | FIGS. 1A to 1C | 0.1 | Aluminum | FIGS. 1A to 1C | None | — | No | No | Yes | Yes |
| Test Example 3 | Polypropylene | FIGS. 1A to 1C | 0.1 | Polypropylene | FIGS. 1A to 1C | None | — | No | No | Yes | Yes |
| Test Example 4 | Polypropylene | FIGS. 1A to 1C | 0.1 | Polypropylene | FIGS. 5A, 5B | None | — | No | No | Yes | Yes |
| Test Example 5 | Polypropylene | FIGS. 1A to 1C | 0.1 | None | — | Polypropylene | FIG. 1B | No | No | Yes | Yes |
| Test Example 6 | Polypropylene | FIGS. 1A to 1C | 0.1 | None | — | Plywood | Secured plate member | No | No | Yes | Yes |
| Test Example 7 | Polypropylene | FIGS. 1A to 1C | 0.1 | None | — | Aluminum | Secured plate member | No | No | Yes | Yes |
| Test Example 8 | Polypropylene | FIGS. 1A to 1C | 0.1 | None | — | Polypropylene | FIG. 5A | No | No | Yes | Yes |

TABLE 2

| | | Installation portion | | | | | | Evaluation (repetitive dropping) | | | |
|---|---|---|---|---|---|---|---|---|---|---|---|
| | | | | | | | | 5 times | | 50 times | |
| | | | Surface roughness | Installation face reinforcing portion | | Side face reinforcing portion | | dis-place- | | dis-place- | |
| | Plate member | Shape | (mm) | Material | Shape | Material | Shape | ment | Damage | ment | Damage |
| Example 17 | Polypro-pylene | FIGS. 3A, 3B | 1 | Plywood | FIGS. 3A, 3B | Polypro-pylene | FIGS. 3A, 3B | No | No | No | No |
| Example 18 | Polypro-pylene | FIGS. 3A, 3B | 1 | Plywood | FIGS. 3A, 3B | Plywood | Secured plate member | No | No | No | No |
| Example 19 | Polypro-pylene | FIGS. 3A, 3B | 1 | Plywood | FIGS. 3A, 3B | Aluminum | Secured plate member | No | No | No | No |
| Example 20 | Polypro-pylene | FIGS. 3A, 3B | 1 | Plywood | FIGS. 3A, 3B | Polypro-pylene | FIG. 5A | No | No | No | No |
| Example 21 | Polypro-pylene | FIGS. 3A, 3B | 1 | Aluminum | FIGS. 3A, 3B | Polypro-pylene | FIGS. 3A, 3B | No | No | No | No |
| Example 22 | Polypro-pylene | FIGS. 3A, 3B | 1 | Aluminum | FIGS. 3A, 3B | Plywood | Secured plate member | No | No | No | No |
| Example 23 | Polypro-pylene | FIGS. 3A, 3B | 1 | Aluminum | FIGS. 3A, 3B | Aluminum | Secured plate member | No | No | No | No |
| Example 24 | Polypro-pylene | FIGS. 3A, 3B | 1 | Aluminum | FIGS. 3A, 3B | Polypro-pylene | FIG. 5A | No | No | No | No |
| Example 25 | Polypro-pylene | FIGS. 3A, 3B | 1 | Polypro-pylene | FIGS. 3A, 3B | Polypro-pylene | FIGS. 3A, 3B | No | No | No | No |
| Example 26 | Polypro-pylene | FIGS. 3A, 3B | 1 | Polypro-pylene | FIGS. 3A, 3B | Plywood | Secured plate member | No | No | No | No |
| Example 27 | Polypro-pylene | FIGS. 3A, 3B | 1 | Polypro-pylene | FIGS. 3A, 3B | Aluminum | Secured plate member | No | No | No | No |
| Example 28 | Polypro-pylene | FIGS. 3A, 3B | 1 | Polypro-pylene | FIGS. 3A, 3B | Polypro-pylene | FIG. 5A | No | No | No | No |
| Example 29 | Polypro-pylene | FIGS. 3A, 3B | 1 | Polypro-pylene | FIGS. 5A, 5B | Polypro-pylene | FIGS. 3A, 3B | No | No | No | No |
| Example 30 | Polypro-pylene | FIGS. 3A, 3B | 1 | Polypro-pylene | FIGS. 5A, 5B | Plywood | Secured plate member | No | No | No | No |
| Example 31 | Polypro-pylene | FIGS. 3A, 3B | 1 | Polypro-pylene | FIGS. 5A, 5B | Aluminum | Secured plate member | No | No | No | No |
| Example 32 | Polypro-pylene | FIGS. 3A, 3B | 1 | Polypro-pylene | FIGS. 5A, 5B | Polypro-pylene | FIG. 5A | No | No | No | No |
| Test Example 9 | Polypro-pylene | FIGS. 3A, 3B | 1 | Plywood | FIGS. 3A, 3B | None | — | No | No | Yes | Yes |
| Test Example 10 | Polypro-pylene | FIGS. 3A, 3B | 1 | Aluminum | FIGS. 3A, 3B | None | — | No | No | Yes | Yes |
| Test Example 11 | Polypro-pylene | FIGS. 3A, 3B | 1 | Polypro-pylene | FIGS. 3A, 3B | None | — | No | No | Yes | Yes |
| Test Example 12 | Polypro-pylene | FIGS. 3A, 3B | 1 | Polypro-pylene | FIGS. 5A, 5B | None | — | No | No | Yes | Yes |
| Test Example 13 | Polypro-pylene | FIGS. 3A, 3B | 1 | None | — | Polypro-pylene | FIGS. 3A, 3B | No | No | Yes | Yes |
| Test Example 14 | Polypro-pylene | FIGS. 3A, 3B | 1 | None | — | Plywood | Secured plate member | No | No | Yes | Yes |
| Test Example 15 | Polypro-pylene | FIGS. 3A, 3B | 1 | None | — | Aluminum | Secured plate member | No | No | Yes | Yes |
| Test Example 16 | Polypro-pylene | FIGS. 3A, 3B | 1 | None | — | Polypro-pylene | FIG. 5A | No | No | Yes | Yes |

TABLE 3

| | | Installation portion | | | | | | Evaluation (repetitive dropping) | | | |
|---|---|---|---|---|---|---|---|---|---|---|---|
| | | | | | | | | 5 times | | 50 times | |
| | | | Surface roughness | Installation face reinforcing portion | | Side face reinforcing portion | | Dis-place- | | Dis-place- | |
| | Plate member | Shape | (mm) | Material | Shape | Material | Shape | ment | Damage | ment | Damage |
| Example 33 | Polypro-pylene | FIGS. 6A to 6C | 0.1 | Polypro-pylene | FIGS. 6A to 6C | Polypro-pylene | FIGS. 6A to 6C | No | No | No | No |
| Example 34 | Polypro-pylene | FIGS. 6A to 6C | 0.1 | Polypro-pylene | FIGS. 6A to 6C | Plywood | Secured plate member | No | No | No | No |
| Example 35 | Polypro-pylene | FIGS. 6A to 6C | 0.1 | Polypro-pylene | FIGS. 6A to 6C | Aluminum | Secured plate member | No | No | No | No |
| Example 36 | Polypro-pylene | FIGS. 6A to 6C | 0.1 | Polypro-pylene | FIGS. 6A to 6C | Polypro-pylene | FIG. 5A | No | No | No | No |
| Example 37 | Polypro-pylene | FIGS. 6A to 6C | 0.1 | Plywood | Secured plate member | Polypro-pylene | FIGS. 6A to 6C | No | No | No | No |
| Example 38 | Polypro-pylene | FIGS. 6A to 6C | 0.1 | Plywood | Secured plate member | Plywood | Secured plate member | No | No | No | No |
| Example 39 | Polypro-pylene | FIGS. 6A to 6C | 0.1 | Plywood | Secured plate member | Aluminum | Secured plate member | No | No | No | No |
| Example 40 | Polypro-pylene | FIGS. 6A to 6C | 0.1 | Plywood | Secured plate member | Polypro-pylene | FIG. 5A | No | No | No | No |
| Example 41 | Polypro-pylene | FIGS. 6A to 6C | 0.1 | Aluminum | Secured plate member | Polypro-pylene | FIGS. 6A to 6C | No | No | No | No |
| Example 42 | Polypro-pylene | FIGS. 6A to 6C | 0.1 | Aluminum | Secured plate member | Plywood | Secured plate member | No | No | No | No |
| Example 43 | Polypro-pylene | FIGS. 6A to 6C | 0.1 | Aluminum | Secured plate member | Aluminum | Secured plate member | No | No | No | No |
| Example 44 | Polypro-pylene | FIGS. 6A to 6C | 0.1 | Aluminum | Secured plate member | Polypro-pylene | FIG. 5A | No | No | No | No |
| Example 45 | Polypro-pylene | FIGS. 6A to 6C | 0.1 | Polypro-pylene | FIGS. 9A, 9B | Polypro-pylene | FIGS. 6A to 6C | No | No | No | No |
| Example 46 | Polypro-pylene | FIGS. 6A to 6C | 0.1 | Polypro-pylene | FIGS. 9A, 9B | Plywood | Secured plate member | No | No | No | No |
| Example 47 | Polypro-pylene | FIGS. 6A to 6C | 0.1 | Polypro-pylene | FIGS. 9A, 9B | Aluminum | Secured plate member | No | No | No | No |
| Example 48 | Polypro-pylene | FIGS. 6A to 6C | 0.1 | Polypro-pylene | FIGS. 9A, 9B | Polypro-pylene | FIG. 5A | No | No | No | No |
| Test Example 17 | Polypro-pylene | FIGS. 6A to 6C | 0.1 | Polypro-pylene | FIGS. 6A to 6C | None | — | No | No | Yes | No |
| Test Example 18 | Polypro-pylene | FIGS. 6A to 6C | 0.1 | Plywood | Secured plate member | None | — | No | No | Yes | No |
| Test Example 19 | Polypro-pylene | FIGS. 6A to 6C | 0.1 | Aluminum | Secured plate member | None | — | No | No | Yes | No |
| Test Example 20 | Polypro-pylene | FIGS. 6A to 6C | 0.1 | Polypro-pylene | FIGS. 9A, 9B | None | — | No | No | Yes | No |
| Test Example 21 | Polypro-pylene | FIGS. 6A to 6C | 0.1 | None | — | Polypro-pylene | FIGS. 6A to 6C | No | No | Yes | No |
| Test Example 22 | Polypro-pylene | FIGS. 6A to 6C | 0.1 | None | — | Plywood | Secured plate member | No | No | Yes | No |
| Test Example 23 | Polypro-pylene | FIGS. 6A to 6C | 0.1 | None | — | Aluminum | Secured plate member | No | No | Yes | No |
| Test Example 24 | Polypro-pylene | FIGS. 6A to 6C | 0.1 | None | — | Polypro-pylene | FIG. 5A | No | No | Yes | No |

TABLE 4

| | | Installation portion | | | | | | Evaluation (repetitive dropping) | | | |
|---|---|---|---|---|---|---|---|---|---|---|---|
| | | | | | | | | 5 times | | 50 times | |
| | | | Surface roughness | Installation face reinforcing portion | | Side face reinforcing portion | | Dis-place- | | Dis-place- | |
| | Plate member | Shape | (mm) | Material | Shape | Material | Shape | ment | Damage | ment | Damage |
| Example 49 | Polypro-pylene | FIGS. 11A, 11B | 1 | Polypro-pylene | FIGS. 11A, 11B | Polypro-pylene | FIGS. 11A, 11B | No | No | No | No |
| Example 50 | Polypro-pylene | FIGS. 11A, 11B | 1 | Polypro-pylene | FIGS. 11A, 11B | Plywood | Secured plate member | No | No | No | No |
| Example 51 | Polypro-pylene | FIGS. 11A, 11B | 1 | Polypro-pylene | FIGS. 11A, 11B | Aluminum | Secured plate member | No | No | No | No |
| Example 52 | Polypro-pylene | FIGS. 11A, 11B | 1 | Polypro-pylene | FIGS. 11A, 11B | Polypro-pylene | FIG. 5A | No | No | No | No |
| Example 53 | Polypro-pylene | FIGS. 11A, 11B | 1 | Plywood | Secured plate member | Polypro-pylene | FIGS. 11A, 11B | No | No | No | No |
| Example 54 | Polypro-pylene | FIGS. 11A, 11B | 1 | Plywood | Secured plate member | Plywood | Secured plate member | No | No | No | No |
| Example 55 | Polypro-pylene | FIGS. 11A, 11B | 1 | Plywood | Secured plate member | Aluminum | Secured plate member | No | No | No | No |
| Example 56 | Polypro-pylene | FIGS. 11A, 11B | 1 | Plywood | Secured plate member | Polypro-pylene | FIG. 5A | No | No | No | No |
| Example 57 | Polypro-pylene | FIGS. 11A, 11B | 1 | Aluminum | Secured plate member | Polypro-pylene | FIGS. 11A, 11B | No | No | No | No |
| Example 58 | Polypro-pylene | FIGS. 11A, 11B | 1 | Aluminum | Secured plate member | Plywood | Secured plate member | No | No | No | No |
| Example 59 | Polypro-pylene | FIGS. 11A, 11B | 1 | Aluminum | Secured plate member | Aluminum | Secured plate member | No | No | No | No |
| Example 60 | Polypro-pylene | FIGS. 11A, 11B | 1 | Aluminum | Secured plate member | Polypro-pylene | FIG. 5A | No | No | No | No |
| Example 61 | Polypro-pylene | FIGS. 11A, 11B | 1 | Polypro-pylene | FIG. 9A, 9B | Polypro-pylene | FIGS. 11A, 11B | No | No | No | No |
| Example 62 | Polypro-pylene | FIGS. 11A, 11B | 1 | Polypro-pylene | FIG. 9A, 9B | Plywood | Secured plate member | No | No | No | No |
| Example 63 | Polypro-pylene | FIGS. 11A, 11B | 1 | Polypro-pylene | FIG. 9A, 9B | Aluminum | Secured plate member | No | No | No | No |
| Example 64 | Polypro-pylene | FIGS. 11A, 11B | 1 | Polypro-pylene | FIG. 9A, 9B | Polypro-pylene | FIG. 5A | No | No | No | No |
| Test Example 25 | Polypro-pylene | FIGS. 11A, 11B | 1 | Polypro-pylene | FIGS. 11A, 11B | None | — | No | No | Yes | No |
| Test Example 26 | Polypro-pylene | FIGS. 11A, 11B | 1 | Plywood | Secured plate member | None | — | No | No | Yes | No |
| Test Example 27 | Polypro-pylene | FIGS. 11A, 11B | 1 | Aluminum | Secured plate member | None | — | No | No | Yes | No |
| Test Example 28 | Polypro-pylene | FIGS. 11A, 11B | 1 | Polypro-pylene | FIG. 9A, 9B | None | — | No | No | Yes | No |
| Test Example 29 | Polypro-pylene | FIGS. 11A, 11B | 1 | None | — | Polypro-pylene | FIGS. 11A, 11B | No | No | Yes | No |
| Test Example 30 | Polypro-pylene | FIGS. 11A, 11B | 1 | None | — | Plywood | Secured plate member | No | No | Yes | No |
| Test Example 31 | Polypro-pylene | FIGS. 11A, 11B | 1 | None | — | Aluminum | Secured plate member | No | No | Yes | No |
| Test Example 32 | Polypro-pylene | FIGS. 11A, 11B | 1 | None | — | Polypro-pylene | FIG. 5A | No | No | Yes | No |

TABLE 5

| | | Installation portion | | | | | | Evaluation (repetitive dropping) | | | |
|---|---|---|---|---|---|---|---|---|---|---|---|
| | | | | | | | | 5 times | | 50 times | |
| | | | Surface roughness | Installation face reinforcing portion | | Side face reinforcing portion | | Dis-place- | | Dis-place- | |
| | Plate member | Shape | (mm) | Material | Shape | Material | Shape | ment | Damage | ment | Damage |
| Example 65 | Polypro-pylene | FIGS. 12A, 12B | 1 | Polypro-pylene | FIGS. 12A, 12B | Polypro-pylene | FIGS. 12A, 12B | No | No | No | No |
| Example 66 | Polypro-pylene | FIGS. 12A, 12B | 1 | Polypro-pylene | FIGS. 12A, 12B | Plywood | Secured plate member | No | No | No | No |
| Example 67 | Polypro-pylene | FIGS. 12A, 12B | 1 | Polypro-pylene | FIGS. 12A, 12B | Aluminum | Secured plate member | No | No | No | No |
| Example 68 | Polypro-pylene | FIGS. 12A, 12B | 1 | Polypro-pylene | FIGS. 12A, 12B | Polypro-pylene | FIG. 5A | No | No | No | No |
| Example 69 | Polypro-pylene | FIGS. 12A, 12B | 1 | Plywood | Secured plate member | Polypro-pylene | FIGS. 12A, 12B | No | No | No | No |
| Example 70 | Polypro-pylene | FIGS. 12A, 12B | 1 | Plywood | Secured plate member | Plywood | Secured plate member | No | No | No | No |
| Example 71 | Polypro-pylene | FIGS. 12A, 12B | 1 | Plywood | Secured plate member | Aluminum | Secured plate member | No | No | No | No |
| Example 72 | Polypro-pylene | FIGS. 12A, 12B | 1 | Plywood | Secured plate member | Polypro-pylene | FIG. 5A | No | No | No | No |
| Example 73 | Polypro-pylene | FIGS. 12A, 12B | 1 | Aluminum | Secured plate member | Polypro-pylene | FIGS. 12A, 12B | No | No | No | No |
| Example 74 | Polypro-pylene | FIGS. 12A, 12B | 1 | Aluminum | Secured plate member | Plywood | Secured plate member | No | No | No | No |
| Example 75 | Polypro-pylene | FIGS. 12A, 12B | 1 | Aluminum | Secured plate member | Aluminum | Secured plate member | No | No | No | No |
| Example 76 | Polypro-pylene | FIGS. 12A, 12B | 1 | Aluminum | Secured plate member | Polypro-pylene | FIG. 5A | No | No | No | No |
| Example 77 | Polypro-pylene | FIGS. 12A, 12B | 1 | Polypro-pylene | FIGS. 9A, 9B | Polypro-pylene | FIGS. 12A, 12B | No | No | No | No |
| Example 78 | Polypro-pylene | FIGS. 12A, 12B | 1 | Polypro-pylene | FIGS. 9A, 9B | Plywood | Secured plate member | No | No | No | No |
| Example 79 | Polypro-pylene | FIGS. 12A, 12B | 1 | Polypro-pylene | FIGS. 9A, 9B | Aluminum | Secured plate member | No | No | No | No |
| Example 80 | Polypro-pylene | FIGS. 12A, 12B | 1 | Polypro-pylene | FIGS. 9A, 9B | Polypro-pylene | FIG. 5A | No | No | No | No |
| Test Example 33 | Polypro-pylene | FIGS. 12A, 12B | 1 | Polypro-pylene | FIGS. 12A, 12B | None | — | No | No | Yes | No |
| Test Example 34 | Polypro-pylene | FIGS. 12A, 12B | 1 | Plywood | Secured plate member | None | — | No | No | Yes | No |
| Test Example 35 | Polypro-pylene | FIGS. 12A, 12B | 1 | Aluminum | Secured plate member | None | — | No | No | Yes | No |
| Test Example 36 | Polypro-pylene | FIGS. 12A, 12B | 1 | Polypro-pylene | FIGS. 9A, 9B | None | — | No | No | Yes | No |
| Test Example 37 | Polypro-pylene | FIGS. 12A, 12B | 1 | None | — | Polypro-pylene | FIGS. 12A, 12B | No | No | Yes | No |
| Test Example 38 | Polypro-pylene | FIGS. 12A, 12B | 1 | None | — | Plywood | Secured plate member | No | No | Yes | No |
| Test Example 39 | Polypro-pylene | FIGS. 12A, 12B | 1 | None | — | Aluminum | Secured plate member | No | No | Yes | No |
| Test Example 40 | Polypro-pylene | FIGS. 12A, 12B | 1 | None | — | Polypro-pylene | FIG. 5A | No | No | Yes | No |

TABLE 6

| | | | Surface | | | | | 5 times | | 50 times | |
|---|---|---|---|---|---|---|---|---|---|---|---|
| | | Shape | roughness (mm) | Material | Shape | Material | Shape | Displacement | Damage | Displacement | Damage |
| Example 81 | Cardboard | FIGS. 14A, 14B | 0 | — | — | — | — | No | No | No | No |
| Example 82 | Cardboard | FIGS. 13A to 13C | 0 | — | — | — | — | No | No | No | No |
| Comparative Example 1 | Cardboard | FIGS. 1A to 1C | 0 | None | — | None | — | Yes | Yes | Yes | Yes |

As clearly indicated by the results shown in Tables 1 to 6, in the case where the packaging materials of Examples were used, neither positional displacement nor damages occurred in the packaged and housed honeycomb structured bodies after the repetitive tests of five times, and of 50 times.

In the case where the packaging materials of Test Examples were used, neither positional displacement nor damages occurred after the repetitive test of five times; however, after the repetitive test of 50 times, positional displacement, or positional displacement as well as damages occurred.

Moreover, in the case where the packaging materials of Comparative Examples were used, positional displacement and damages occurred at the time of repetitive tests of five times.

In the meantime, the positional displacement here refers to a state in which the packaging function has been lost due to the displacement of the object to be packaged from the installation position, or deformation of the packaging material.

What is claimed as new and desired to be secured by Letters Patent of the United States is:

1. A method of transporting a honeycomb structured body by housing the honeycomb structured body packaged with a packaging material in a box member, and then transporting said box member, wherein said packaging material, which is formed by molding a plastic sheet, packages the honeycomb structured body by sandwiching the honeycomb structured body, said plastic sheet is provided with an installation portion for the honeycomb structured body, and provided as well with a reinforcing portion, said reinforcing portion is a groove portion in said plastic sheet and crosses and intersects with another reinforcing portion that is another groove portion in said plastic sheet, the crossing and the intersecting occurs at a location other than at a retention location of the honeycomb structured body, a peripheral side face of the packaging material is formed by bending the plastic sheet downward, and a plurality of grooves are formed on the peripheral side face, wherein irregularities of about 1 mm or more are formed on said installation portion.

2. The method of transporting a honeycomb structured body according to claim 1, wherein irregularities having a surface roughness Ra of about 0.1 μm or more are formed on said installation portion.

3. The method of transporting a honeycomb structured body according to claim 1, wherein the shape of said installation portion is a truncated cone shape.

4. The method of transporting a honeycomb structured body according to claim 1, wherein said installation portion is formed by forming a bottomed hole in said plastic sheet.

5. The method of transporting a honeycomb structured body according to claim 4, wherein an installation area for the honeycomb structured body in said bottomed hole is smaller than an opening area of said bottomed hole.

6. The method of transporting a honeycomb structured body according to claim 4, wherein said bottomed hole has such a shape that, when the honeycomb structured body is placed therein, a gap is formed between the bottomed hole and the honeycomb structured body.

7. The method of transporting a honeycomb structured body according to claim 4, wherein a raised bottom portion to hold the end face of the honeycomb structured body is formed on the bottom face of said bottomed hole.

8. A method of transporting a honeycomb structured body by housing the honeycomb structured body packaged with a packaging material in a box member, and then transporting said box member, wherein said packaging material, which is formed by molding a plastic sheet, is a packaging material for packaging the honeycomb structured body by sandwiching the honeycomb structured body;

said plastic sheet is provided with a reinforcing portion, said reinforcing portion is a groove portion in said plastic sheet and crosses and intersects with another reinforcing portion that is another groove portion in said plastic sheet, the crossing and intersecting occurs at a location other than at a retention location of the honeycomb structured body;

the plastic sheet is provided with an installation portion for said honeycomb structured body comprising a bottomed hole; and the bottomed hole has such a shape that, when the honeycomb structured body is placed therein, a gap is formed between the bottomed hole and the honeycomb structured body such that a peripheral portion of an end face of the honeycomb structured body does not contact the installation portion, wherein irregularities of about 1 mm or more are formed on said installation portion.

9. The method of transporting a honeycomb structured body according to claim 8, wherein irregularities having a surface roughness Ra of about 0.1 μm or more are formed on said installation portion.

10. The method of transporting a honeycomb structured body according to claim 8, wherein the shape of said installation portion is a truncated cone shape.

11. The method of transporting a honeycomb structured body according to claim 8, wherein an installation area for the honeycomb structured body in said bottomed hole is smaller than an opening area of said bottomed hole.

12. The method of transporting a honeycomb structured body according to claim 8, wherein a raised bottom portion to hold the end face of the honeycomb structured body is formed on the bottom face of said bottomed hole.

13. The method of transporting a honeycomb structured body according to claim 1, wherein said installation portion is formed so that a diameter of an upper face of the installation portion is made shorter than a diameter of the end face of the honeycomb structured body.

14. The method of transporting a honeycomb structured body according to claim 1, wherein said plastic sheet comprises polypropylene, polyethylene, or polyethylene terephthalate.

15. The method of transporting a honeycomb structured body according to claim 8, wherein said installation portion is formed that a diameter of an upper face of the installation portion is made shorter than a diameter of the end face of the honeycomb structured body.

16. The method of transporting a honeycomb structured body according to claim 8, wherein said plastic sheet comprises polypropylene, polyethylene, or polyethylene terephthalate.

17. The method of transporting a honeycomb structured body according to claim 8, wherein said plastic sheet is provided with a reinforcing portion, and wherein said reinforcing portion and the portion other than the reinforcing portion are formed by different materials.

* * * * *

UNITED STATES PATENT AND TRADEMARK OFFICE

CERTIFICATE OF CORRECTION

PATENT NO. : 8,047,377 B2
APPLICATION NO. : 11/762928
DATED : November 1, 2011
INVENTOR(S) : Kenichi Makino It is certified that error appears in the above-identified patent and that said Letters Patent is hereby corrected as shown below:

Title Page:
Item (63) should read as follows:

(63) Continuation of application No. PCT/JP2006/303884, filed on Mar. 1, 2006

Signed and Sealed this
Twentieth Day of March, 2012

David J. Kappos

David J. Kappos
*Director of the United States Patent and Trademark Office*